US010238175B2

(12) United States Patent
Campos, II et al.

(10) Patent No.: US 10,238,175 B2
(45) Date of Patent: Mar. 26, 2019

(54) ARTICLE WITH A CUSHIONING ASSEMBLY HAVING INNER AND OUTER BLADDER ELEMENTS WITH INTERFITTING FEATURES AND METHOD OF MANUFACTURING AN ARTICLE

(71) Applicant: NIKE, Inc., Beaverton, OR (US)

(72) Inventors: Fidencio Campos, II, Dallas, OR (US); Zachary M. Elder, Portland, OR (US); Benjamin J. Monfils, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 306 days.

(21) Appl. No.: 15/093,104

(22) Filed: Apr. 7, 2016

(65) Prior Publication Data

US 2016/0295967 A1 Oct. 13, 2016

Related U.S. Application Data

(60) Provisional application No. 62/144,576, filed on Apr. 8, 2015.

(51) Int. Cl.
*A43B 13/20* (2006.01)
*A63B 71/08* (2006.01)
(Continued)

(52) U.S. Cl.
CPC ..... *A43B 13/20* (2013.01); *A43B 1/0072* (2013.01); *A43B 13/125* (2013.01);
(Continued)

(58) Field of Classification Search
CPC ..... A43B 13/20; A43B 13/125; A43B 1/0072; A43B 13/12
See application file for complete search history.

(56) References Cited

U.S. PATENT DOCUMENTS 2,269,342 A * 1/1942 Johnson ..... A47C 27/128 156/289
2,677,906 A 5/1954 Reed
(Continued)

FOREIGN PATENT DOCUMENTS

EP 771694 A2 5/1997
EP 0780064 A2 6/1997
(Continued)

OTHER PUBLICATIONS

American Society for Testing and Materials (ASTM) Standard D1003-00, Standard Test Method for Haze and Luminous Transmittance of Transparent Plastics, Jul. 2000, Book of Standards vol. 08.01, ASTM International, Pennsylvania, USA.

*Primary Examiner* — Jila M Mohandesi
(74) *Attorney, Agent, or Firm* — Quinn IP Law

(57) ABSTRACT

An article includes a cushioning assembly which has a first bladder element forming a first fluid chamber, and a second bladder element within the first bladder element and forming a second fluid chamber sealed from and within the first fluid chamber. The first bladder element includes an inner surface having a first feature. The second bladder element includes an outer surface having a second feature. The first feature interfits with the second feature such that a first area of the inner surface of the first bladder element is aligned with a first area of the outer surface of the second bladder element at a bonded interface. The second bladder element is exposed to the first fluid chamber away from the bonded interface. A method of manufacturing the article includes interfitting the first feature with the second feature and bonding at the bonded interface.

14 Claims, 14 Drawing Sheets

(51) Int. Cl.

| | |
|---|---|
| ***A43B 1/00*** | (2006.01) |
| ***A43B 13/12*** | (2006.01) |
| *A63B 71/14* | (2006.01) |
| *A63B 41/02* | (2006.01) |
| *A63B 71/12* | (2006.01) |

(52) U.S. Cl.
CPC ..... *A63B 71/081* (2013.01); *A63B 41/02* (2013.01); *A63B 71/141* (2013.01); *A63B 2071/125* (2013.01); *A63B 2071/1208* (2013.01); *A63B 2071/1258* (2013.01)

(56) References Cited

U.S. PATENT DOCUMENTS

| | | | | | |
|---|---|---|---|---|---|
| 2,762,134 | A * | 9/1956 | Town | A43B 17/03 | 36/153 |
| 3,110,971 | A * | 11/1963 | Chang | A43B 13/12 | 36/30 R |
| 3,469,576 | A * | 9/1969 | Everts | A43B 13/20 | 36/154 |
| 3,568,227 | A * | 3/1971 | Dunham | A47C 27/081 | 5/644 |
| 4,183,156 | A * | 1/1980 | Rudy | A43B 17/035 | 36/29 |
| 4,219,945 | A | 9/1980 | Rudy | | |
| 4,547,919 | A * | 10/1985 | Wang | A42B 3/122 | 2/18 |
| 4,779,359 | A * | 10/1988 | Famolare, Jr. | A43B 13/20 | 36/28 |
| 4,817,304 | A * | 4/1989 | Parker | A43B 13/20 | 36/114 |
| 4,936,029 | A | 6/1990 | Rudy | | |
| 4,999,931 | A | 3/1991 | Vermeulen | | |
| 5,042,176 | A | 8/1991 | Rudy | | |
| 5,067,252 | A * | 11/1991 | Baillie | B01J 8/24 | 34/589 |
| 5,220,737 | A | 6/1993 | Edington | | |
| 5,564,202 | A | 10/1996 | Hoppenstein | | |
| 5,575,088 | A | 11/1996 | Allen et al. | | |
| 5,713,141 | A | 2/1998 | Mitchell et al. | | |
| 5,952,065 | A | 9/1999 | Mitchell et al. | | |
| 5,979,078 | A * | 11/1999 | McLaughlin | A43B 13/203 | 36/29 |
| 5,985,383 | A | 11/1999 | Allen et al. | | |
| 6,009,637 | A | 1/2000 | Pavone | | |
| 6,013,340 | A | 1/2000 | Bonk et al. | | |
| 6,041,519 | A | 3/2000 | Cheng | | |
| 6,082,025 | A | 7/2000 | Bonk et al. | | |
| 6,127,026 | A | 10/2000 | Bonk et al. | | |
| 6,203,868 | B1 | 3/2001 | Bonk et al. | | |
| 6,321,465 | B1 | 11/2001 | Bonk et al. | | |
| 6,503,355 | B1 | 1/2003 | Anzani et al. | | |
| 6,516,540 | B2 | 2/2003 | Seydel et al. | | |
| 6,537,639 | B1 | 3/2003 | Huang | | |
| 6,751,892 | B2 | 6/2004 | Chavet et al. | | |
| 6,971,193 | B1 | 12/2005 | Potter et al. | | |
| 6,976,321 | B1 | 12/2005 | Lakic | | |
| 7,204,041 | B1 | 4/2007 | Bailey, Sr. et al. | | |
| 7,244,483 | B2 * | 7/2007 | Tawney | A43B 13/20 | 36/28 |
| 7,437,835 | B2 | 10/2008 | Marvin et al. | | |
| 7,451,555 | B1 | 11/2008 | Lakic | | |
| 7,694,438 | B1 | 4/2010 | Christensen et al. | | |
| 7,779,558 | B2 | 8/2010 | Nishiwaki et al. | | |
| 7,788,824 | B2 | 9/2010 | Hann | | |
| 7,802,378 | B2 | 9/2010 | Harmon Weiss et al. | | |
| 8,122,615 | B2 | 2/2012 | Lucas et al. | | |
| 8,125,796 | B2 * | 2/2012 | Ellis | A43B 3/0005 | 257/316 |
| 8,256,147 | B2 * | 9/2012 | Ellis | A43B 7/1425 | 36/103 |
| 8,656,608 | B2 | 2/2014 | Goodwin et al. | | |
| 8,635,786 | B2 | 4/2014 | Aveni et al. | | |
| 8,848,368 | B2 * | 9/2014 | Ellis | A43B 3/0005 | 312/223.2 |
| 2002/0121031 | A1 | 9/2002 | Smith et al. | | |
| 2003/0097767 | A1 | 5/2003 | Perkinson | | |
| 2003/0183324 | A1 * | 10/2003 | Tawney | A43B 13/20 | 156/145 |
| 2004/0148809 | A1 | 8/2004 | Kikuta et al. | | |
| 2006/0137221 | A1 * | 6/2006 | Dojan | A43B 13/20 | 36/29 |
| 2007/0294832 | A1 | 12/2007 | Shiao | | |
| 2009/0151196 | A1 * | 6/2009 | Schindler | A43B 13/12 | 36/29 |
| 2009/0178302 | A1 | 7/2009 | Kim | | |
| 2009/0183387 | A1 * | 7/2009 | Ellis | A41D 19/01523 | 36/29 |
| 2009/0293305 | A1 | 12/2009 | Pelsue et al. | | |
| 2010/0094184 | A1 | 4/2010 | Wong et al. | | |
| 2010/0319214 | A1 | 12/2010 | Issler | | |
| 2011/0162232 | A1 | 7/2011 | Gazzara et al. | | |
| 2011/0162233 | A1 | 7/2011 | Shiao | | |
| 2012/0260524 | A1 * | 10/2012 | Izquieta Anaut | A43B 13/187 | 36/28 |
| 2013/0174447 | A1 | 7/2013 | Sills | | |
| 2013/0227858 | A1 | 9/2013 | James | | |
| 2014/0090189 | A1 | 4/2014 | Parker | | |
| 2014/0230272 | A1 | 8/2014 | Feshbach et al. | | |
| 2014/0230276 | A1 | 8/2014 | Campos, II et al. | | |
| 2014/0250728 | A1 | 9/2014 | Devoe et al. | | |
| 2014/0283413 | A1 | 9/2014 | Christensen et al. | | |
| 2016/0295968 | A1 | 10/2016 | Campos, II et al. | | |
| 2018/0070675 | A1 | 3/2018 | Campos, II et al. | | |

FOREIGN PATENT DOCUMENTS

| | | | |
|---|---|---|---|
| JP | 2002238613 | A | 8/2002 |
| WO | 9111931 | A1 | 8/1991 |
| WO | 0170060 | A2 | 9/2001 |
| WO | 2017079255 | A1 | 5/2017 |

* cited by examiner

ARTICLE WITH A CUSHIONING ASSEMBLY HAVING INNER AND OUTER BLADDER ELEMENTS WITH INTERFITTING FEATURES AND METHOD OF MANUFACTURING AN ARTICLE

CROSS-REFERENCE TO RELATED APPLICATION

This application claims the benefit of U.S. Provisional Application No. 62/144,576 filed Apr. 8, 2015, which is hereby incorporated by reference in its entirety.

TECHNICAL FIELD

The present teachings generally include an article with a cushioning assembly, and a method of manufacturing the article.

BACKGROUND

Footwear typically includes a sole configured to be located under a wearer's foot to space the foot away from the ground or floor surface. Footwear sometimes utilizes polyurethane foam or other resilient materials in the sole to provide cushioning. A fluid-filled bladder element is sometimes included in the sole to provide desired cushioning.

DESCRIPTION

Figure 1:
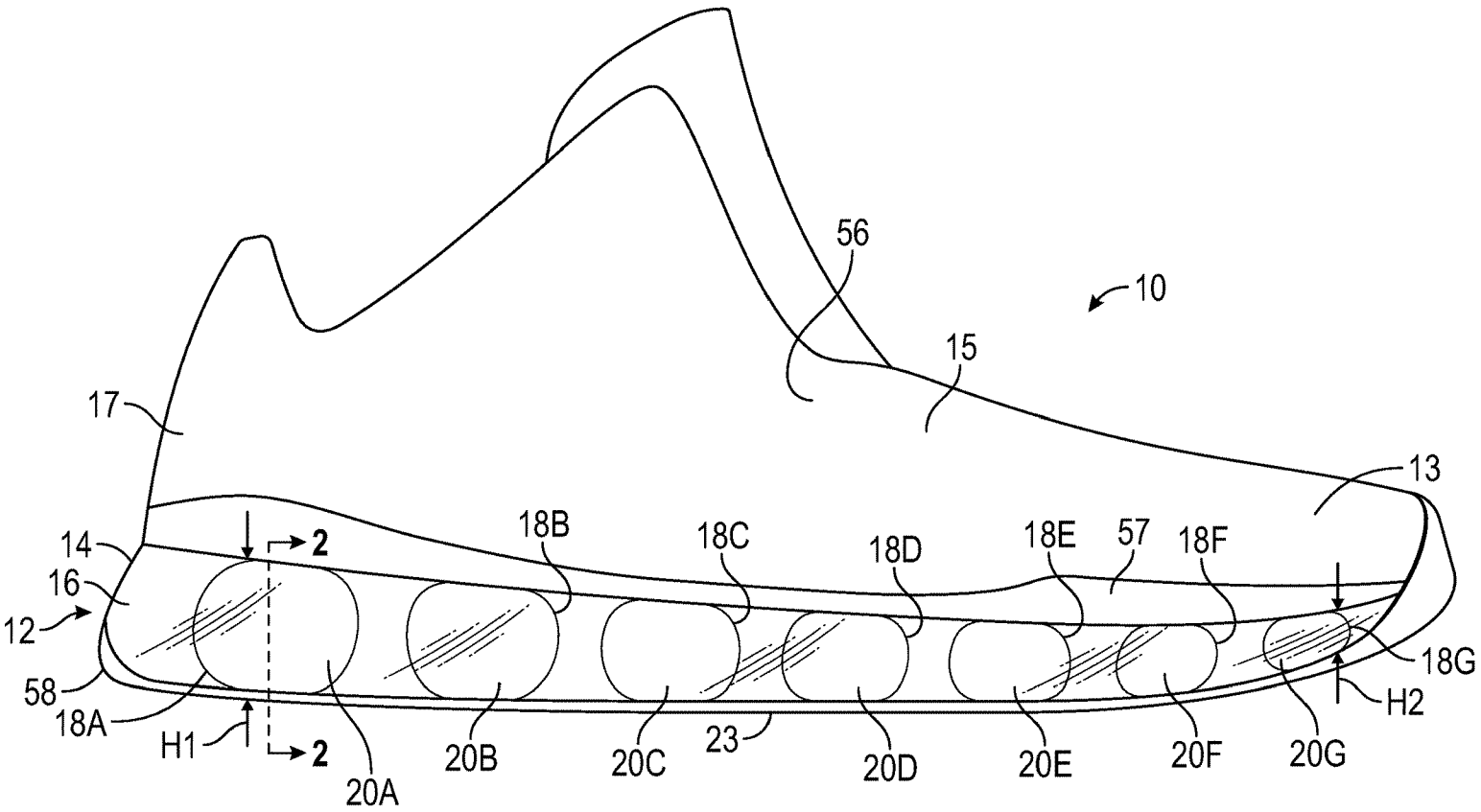
FIG. 1 is a schematic illustration in side view of an article of footwear including a cushioning assembly.

An article comprises a cushioning assembly which includes a first bladder element forming a first fluid chamber, and a second bladder element within the first bladder element and forming a second fluid chamber sealed from and within the first fluid chamber. The first bladder element comprises an inner surface having a first feature. The second bladder element comprises an outer surface having a second feature. The first feature interfits with the second feature such that a first area of the inner surface of the first bladder element is aligned with a first area of the outer surface of the second bladder element at a bonded interface. The second bladder element is exposed to the first fluid chamber away from the bonded interface. As used herein, a component is "exposed" to a chamber when at least a portion of a surface of the component faces and bounds the chamber and is therefore subject to and acted upon by fluid pressure within the chamber.

In one embodiment, the second bladder element comprises a flange forming a peripheral seam that surrounds the second bladder element and seals the second fluid chamber. The bonded interface is disposed on opposing portions of the inner surface of the first bladder element. The peripheral seam inclines within the first bladder element to thereby function as a tether anchoring the opposing portions to one another.

In an embodiment, opposing portions of the second bladder element are bonded to one another at a central area of the second bladder element that is surrounded by the second fluid chamber such that the second fluid chamber is annular. The bonded interface is at the central area, and the first and second bladder elements define a gap around the central area between the second bladder element and the first bladder element. The second bladder element may comprise a flange forming a peripheral seam that seals the second fluid chamber. The central area and the bonded interface are displaced toward the gap relative to the peripheral seam.

In an embodiment, the first feature of the first bladder element comprises a first domed portion of the first bladder element protruding outward from the first bladder element and creating a first concavity at the inner surface of the first bladder element. The second feature of the second bladder element comprises a first domed portion of the second bladder element that fits within the first concavity of the first bladder element. The second feature of the second bladder element may further comprise a second domed portion. The first bladder element may comprise a first sheet bonded to a second sheet to define the first fluid chamber, and the first domed portion may be in the first sheet. The first feature may further comprise a second domed portion of the second sheet protruding outward from the first bladder element and creating a second concavity at the inner surface of the first bladder element. The first domed portion of the second bladder element is cupped by the first domed portion of the first bladder element within the first concavity, and the second domed portion of the second bladder element is cupped by the second domed portion of the first bladder element within the second concavity.

In an embodiment, the second feature of the second bladder element comprises a first domed portion of the second bladder element, and the first feature of the first bladder element comprises a first inward protrusion of the inner surface of the first bladder element and a first central domed portion protruding outward from and surrounded by the first inward protrusion. The first central domed portion establishes a first concavity at the inner surface of the first bladder element. The first domed portion of the second bladder element is cupped by the first central domed portion of the first bladder element within the first concavity.

The second feature of the second bladder element may further comprise a second domed portion of the second bladder element. The first bladder element may comprise a first sheet bonded to a second sheet to define the first fluid chamber. The first inward protrusion with the first central domed portion may be in the first sheet. The first feature of the first bladder element may further comprise a second inward protrusion of the inner surface of the first bladder element and a second central domed portion protruding outward from and surrounded by the second inward protrusion. The second inward protrusion with the second central domed portion may be in the second sheet. The second domed portion of the second bladder element may be cupped by the second central domed portion of the first bladder element within the second concavity of the second central domed portion.

Additionally, a third bladder element may be within the first bladder element and may form a third fluid chamber sealed from both the first fluid chamber and the second fluid chamber. The third bladder element may comprise an additional domed portion. The first bladder element may comprise a third domed portion establishing a third central concavity at the inner surface of the first bladder element. The additional domed portion of the third bladder element may be cupped by the third domed portion of the first bladder element within the third central concavity of the third domed portion. In an embodiment in which the article is an article of footwear, the first bladder element may extend from a forefoot portion to a heel portion of an article of footwear that has a forefoot portion, a heel portion, and a midfoot portion between the forefoot portion and the heel portion, the second bladder element is positioned in the heel portion and the third bladder element is positioned in the forefoot portion. The third fluid chamber has a greater pressure than either of the second fluid chamber and the first fluid chamber when the article of footwear is in an unloaded state.

In an embodiment, the second bladder element comprises a deployable portion that protrudes inward when the second fluid chamber is at ambient pressure and deploys laterally outward into contact with a side portion of the inner surface of the first bladder element under pressurization of the second bladder element. The bonded interface is at the side portion of the inner surface of the first bladder element via the deployable portion and at opposing portions of the inner surface of the first bladder element adjacent the side portion.

In an embodiment, the article further comprises a third bladder element within the first bladder element and forming a third fluid chamber sealed from both the first fluid chamber and the second fluid chamber. The third bladder element comprises an additional surface having a third feature, and the first feature further interfits with the third feature such that an additional area of the inner surface of the first bladder element and the outer surface of the third bladder element establish an additional bonded interface and the third bladder element is exposed to the first fluid chamber away from the additional bonded interface. The article may be an article of footwear that comprises a forefoot portion, a midfoot portion, and a heel portion. The first bladder element may extend from the forefoot portion to the heel portion, the second bladder element may be positioned in the heel portion, and the third bladder element may be positioned in the forefoot portion. The third fluid chamber has a greater pressure than either of the second fluid chamber and the first fluid chamber when the article of footwear is in an unloaded state.

A method of manufacturing an article comprises interfitting a first feature of a first bladder element with a second feature of a second bladder element so that a first area of an inner surface of the first bladder element is aligned with a first area of an outer surface of the second bladder element and the second bladder element is within a first fluid chamber of the first bladder element. The first feature is on the inner surface of the first bladder element and the second feature is on the outer surface of the second bladder element. The second bladder element forms a second fluid chamber that is sealed from and within the first fluid chamber. The method further comprises bonding the first area of the inner surface of the first bladder element to the first area of the outer surface of the second bladder element to establish a bonded interface. The second bladder element is exposed to the first fluid chamber away from the bonded interface.

In an embodiment, the second bladder element comprises a flange forming a peripheral seam that surrounds the second bladder element and seals the second fluid chamber. Interfitting comprises positioning the second bladder element so that the peripheral seam inclines within the first bladder element between opposing portions of the inner surface of the first bladder element, the peripheral seam thereby functioning as a tether anchoring the opposing portions when the first area of the inner surface of the first bladder element is bonded to the first area of the outer surface of the second bladder element.

The second bladder element comprises a flange forming a peripheral seam that surrounds the second bladder element and seals the second fluid chamber. Opposing portions of the second bladder element are bonded to one another at a central area of the second bladder element and are surrounded by the second fluid chamber such that the second fluid chamber is annular. In such an embodiment, the bonding is at the central area.

The second feature of the second bladder element may comprise a first domed portion and a second domed portion. The first bladder element may comprise a first sheet bonded to a second sheet to define the first fluid chamber. The first feature of the first bladder element may comprise a first domed portion of the first sheet protruding outward from the first bladder element and creating a first concavity at the inner surface of the first bladder element. The first feature may further comprise a second domed portion of the second sheet protruding outward from the first bladder element and creating a second concavity at the inner surface of the first bladder element. In such an embodiment, the interfitting comprises cupping the first domed portion of the second bladder element by the first domed portion of the first bladder element within the first concavity, and cupping the second domed portion of the second bladder element by the second domed portion of the first bladder element within the second concavity, the interfitting first and second features thereby aligning the second bladder element within the first bladder element.

In an embodiment, the second bladder element comprises a deployable portion that protrudes inward when the second fluid chamber is at ambient pressure and deploys laterally outward into contact with a side portion of the inner surface of the first bladder element under pressurization of the second bladder element. The second bladder element is configured so that the bonded interface includes the side portion of the inner surface of the first bladder element via the deployable portion, and further includes opposing portions of the first bladder element adjacent the side portion. In such an embodiment, the method further comprises inflating the second fluid chamber of the second bladder element to a predetermined pressure sufficient to deploy the deployable portion into contact with the side portion of the inner surface of the first bladder element prior to said bonding.

In an embodiment, the article is an article of footwear that comprises a forefoot portion, a midfoot portion, and a heel portion. The first bladder element extends from the forefoot portion to the heel portion. The article of footwear comprises a third bladder element that is within the first bladder element and forms a third fluid chamber sealed from both the first fluid chamber and the second fluid chamber. The third bladder element comprises an additional surface having a third feature. The first feature further interfits with the third feature such that an additional area of the inner surface of the first bladder element and the outer surface of the third bladder element establish an additional bonded interface and the third bladder element is exposed to the first fluid chamber away from the additional bonded interface. In such an embodiment, a map of magnitudes of pressures applied during wear testing of an article of footwear can be determined. The second fluid chamber of the second bladder element and the third fluid chamber of the third bladder element can then be inflated to pressurize the second fluid chamber and the third fluid chamber to respective pressures that correlate with the pressure map.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like features throughout the views, FIG. 1 shows an article 10 that includes a cushioning assembly 12 having features that are configured to provide a desired level of cushioning, stability, and responsiveness. As shown in FIG. 1, the article 10 is an article of footwear 10 that is an athletic shoe. In other embodiments, the cushioning assembly 12 could be for an article of footwear that is a dress shoe, a work shoe, a sandal, a slipper, a boot, or any other category of footwear. Alternatively, the cushioning assembly 12 could be used as a cushioning element in another article, such as but not limited to a shoulder strap, a backpack, a shoulder pad, a glove, an elbow pad, a knee pad, a shin guard, or other apparel, or a sports ball.

Figure 2:
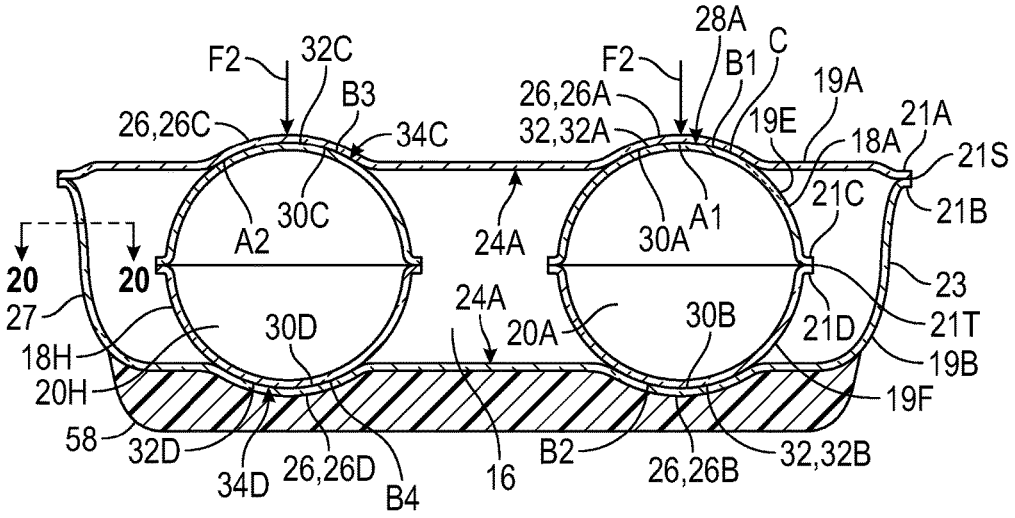
FIG. 2 is a schematic illustration in cross-sectional view of the cushioning assembly of FIG. 1 taken at lines 2-2 in FIG. 1.

More specifically, the cushioning assembly 12 has multiple bladder elements, including a first bladder element 14 forming a first fluid chamber 16, and a second bladder element 18A within the first bladder element 14 and multiple additional bladder elements 18B, 18C, 18D, 18E, 18F, 18G, and 18H within the bladder element 14. The second bladder element 18A forms a second fluid chamber 20A that is sealed from and within the first fluid chamber 16. Due to this arrangement, the first bladder element 14 is also referred to as an outer bladder element, and the second bladder element 18A is also referred to as an inner bladder element. The article of footwear 10 comprises a forefoot portion 13, a midfoot portion 15, and a heel portion 17. The forefoot portion 13 is generally the forward-most third of the article of footwear 10 when worn on a foot, the midfoot portion 15 is generally the middle third, and the heel portion 17 is generally the rearmost third. The first bladder element 14 of the cushioning assembly 12 is referred to as a full length bladder element 14 as it extends from the forefoot portion 13, over the midfoot portion 15 to the heel portion 17. Heel portion 17 generally includes portions of the article of footwear 10 and cushioning assembly 12 corresponding with rear portions of a human foot of a size corresponding with the article of footwear 10, including the calcaneus bone. Forefoot portion 13 generally includes portions of the article of footwear 10 and cushioning assembly 12 corresponding with the toes and the joints connecting the metatarsals with the phalanges of the human foot of the size corresponding with the article of footwear 10. Midfoot portion 15 generally includes portions of the article of footwear 10 and cushioning assembly 12 corresponding with an arch area of the human foot of the size corresponding with the article of footwear 10. As used herein, a lateral side of a component for an article of footwear 10, such as a lateral side 23 of the cushioning assembly 12 indicated in FIGS. 1 and 2, is a side that corresponds with the side of the foot of the wearer of the article of footwear 10 that is generally further from the other foot of the wearer (i.e., the side closer to the fifth toe of the wearer). The fifth toe is commonly referred to as the little toe. A medial side of a component for an article of footwear 10, such as a medial side 27 of the cushioning assembly 12 indicated in FIG. 2, is the side that corresponds with an inside area of the foot of the wearer and is generally closer to the other foot of the wearer (i.e., the side closer to the hallux of the foot of the wearer). The hallux is commonly referred to as the big toe.

As further discussed herein, the cushioning assembly 12 also includes multiple additional inner bladder elements 18B, 18C, 18D, 18E, 18F, 18G, 18H, each of which is also within the first bladder element 14. The cushioning assembly may include additional bladder elements not visible in FIGS. 1 and 2. For example, respective additional bladder elements may be positioned within the first bladder element 14 and laterally adjacent each bladder element 18A, 18B, 18C, 18D, 18E, 18F, 18G, similar to the relative positioning of bladder elements 18A and 18H in FIG. 2. Each additional inner bladder element 18B, 18C, 18D, 18E, 18F, 18G, 18H forms a separate fluid chamber 20B, 20C, 20D, 20E, 20F, 20G, 20H that is sealed from and within the first fluid filled chamber 16. For purposes of discussion, any of the additional inner bladder elements 18B, 18C, 18D, 18E, 18F, 18G, 18H may be referred to as a third bladder element, and the corresponding separate fluid chamber 20B, 20C, 20D, 20E, 20F, 20G, 20H may be referred to as the third fluid chamber. As is apparent in FIG. 1, the inner bladder elements 18A, 18B, 18C, 18D, 18E, 18F, 18G and 18H decrease in height from the heel portion 17 to the forefoot portion 13. Bladder element 18A is of the largest height H1, and bladder element 18G is of the smallest height H2.

As used herein, a "fluid" includes a gas, including air, an inert gas such as nitrogen, or another gas. Accordingly, "fluid-filled" includes "gas-filled". The various materials used for the bladder elements 14, 18A, 18B, 18C, 18D, 18E, 18F, 18G, 18H, and other embodiments of bladder elements discussed herein, may be substantially transparent. The various materials used for the bladder element 14, and other embodiments of bladder elements discussed herein, may be substantially transparent. Additionally, in some embodiments, the bladder elements 14, 18A, 18B, 18C, 18D, 18E, 18F, 18G, 18H may have a tinted color.

The fluid-filled bladder elements 14, 18A, 18B, 18C, 18D, 18E, 18F, 18G, 18H and other embodiments of bladder elements described herein can be formed from a variety of polymeric materials. For example, the bladder elements 14, 18A, 18B, 18C, 18D, 18E, 18F, 18G, 18H can be formed from any of various polymeric materials that can retain a fluid at a predetermined pressure, including a fluid that is a gas, such as air, nitrogen, or another gas. For example, the bladder elements 14, 18A, 18B, 18C, 18D, 18E, 18F, 18G, 18H can be a thermoplastic polymeric material. The bladder elements 14, 18A, 18B, 18C, 18D, 18E, 18F, 18G, 18H can be a urethane, polyurethane, polyester, polyester polyurethane, and/or polyether polyurethane.

Figure 20:
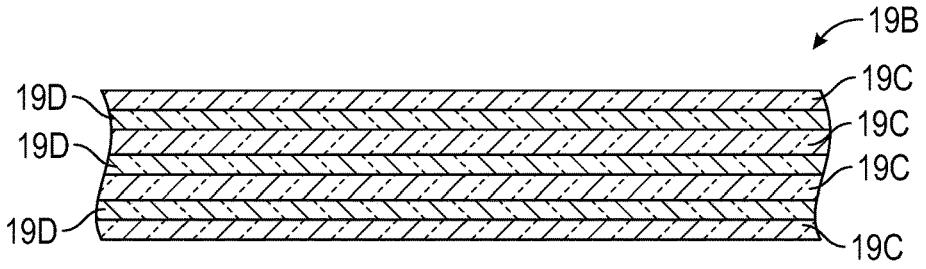
FIG. 20 is a schematic illustration in fragmentary cross-sectional view of a portion of a polymeric sheet of a bladder element of FIG. 2 taken at lines 20-20 in FIG. 2.

Moreover, the bladder elements 14, 18A, 18B, 18C, 18D, 18E, 18F, 18G, 18H can be formed of one or more sheets having layers of different materials. As shown in FIG. 2, the first bladder element 14 is formed from a first polymeric sheet 19A secured to a second polymeric sheet 19B. A peripheral flange 21A of the first polymeric sheet 19A is secured to a peripheral flange 21B of the second polymeric sheet 19B, forming a peripheral seam 21S. FIG. 20 shows that the second polymeric sheet 19B is a laminate membrane formed from thin films having one or more first layers 19C that comprise thermoplastic polyurethane layers and that alternate with one or more second layers 19D, also referred to herein as barrier layers, gas barrier polymers, or gas barrier layers. The second layers 19D comprise a copolymer of ethylene and vinyl alcohol (EVOH) that is impermeable to the pressurized fluid contained therein as disclosed in U.S. Pat. No. 6,082,025 to Bonk et al., which is incorporated by reference in its entirety. The first layer 19C may be arranged to form an outer surface of the second polymeric sheet 19B. That is, the outermost first layer 19C shown in FIG. 20 may be the outer surface of the first bladder element 14. The first bladder element 14 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The bladder element 14 may also be a flexible microlayer membrane that includes alternating layers of a gas barrier polymer material such as second layers 19D and an elastomeric material such as first layers 19C, as disclosed in U.S. Pat. Nos. 6,082,025 and 6,127,026 to Bonk et al. which are incorporated by reference in their entireties. With such alternating layers, for example, the bladder element 14 or any of the additional bladder elements 18A, 18B, 18C, 18D, 18E, 18F, 18G, 18H may have a gas transmission rate for nitrogen of less than 10 cubic centimeters per square meter per atmosphere per day, or of less than 1 cubic centimeter per square meter per atmosphere per day. Additional suitable materials for the bladder element 14 are disclosed in U.S. Pat. Nos. 4,183,156 and 4,219,945 to Rudy which are incorporated by reference in their entireties. Further suitable materials for the bladder element 14 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the bladder element 14, engineering properties such as tensile strength, stretch properties, fatigue characteristics, dynamic modulus, and loss tangent can be considered. The thicknesses of the first and second polymeric sheets 19A, 19B of materials used to form the bladder element 14 can be selected to provide these characteristics. The first polymeric sheet 19A may be formed from any of the same materials shown and described in FIG. 20 with respect to the second polymeric sheet 19B.

With reference to FIG. 2, the first sheet 19A of the first bladder element 14 comprises an inner surface 24A having a first feature 26. The first feature 26 includes a first domed portion 26A. The first domed portion 26A is a formed geometrical shape that protrudes outward from the first bladder element 14 creating a first concavity 30A at the inner surface 24A of the first bladder element 14.

Figure 3:
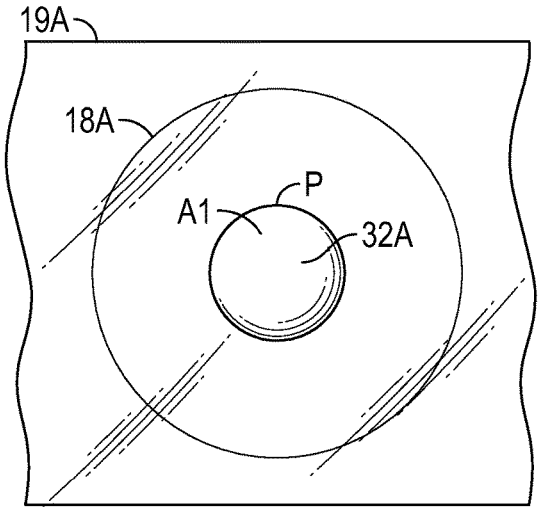
FIG. 3 is a schematic illustration in fragmentary top view of a portion of the cushioning assembly of FIG. 1.

The second bladder element 18A may be formed from a first polymeric sheet 19E secured to a second polymeric sheet 19F at peripheral flanges 21C, 21D of the respective sheets 19E, 19F forming a peripheral seam 21T to seal and define the second fluid chamber 20A. The first polymeric sheet 19E of the second bladder element 18A comprises an outer surface 28A having a second feature 32. The second feature 32 of the second bladder element 18A includes a first domed portion 32A of the second bladder element 18A. The first domed portion 32A fits within the first concavity 30A of the first bladder element 14. In this manner, the first feature 26 interfits with the second feature 32 such that a first area A1 of the inner surface 24A of the first bladder element 14 is aligned with a first area C of the outer surface 28A of the second bladder element 18A at a bonded interface B1. The first area A1 of the inner surface 24A is the area bounded by the perimeter P of the first domed portion 26A as indicated in FIG. 3. The first area C of the second bladder element 18A is the area covered by and in contact with the first domed portion 26A. The second bladder element 18A is exposed to the first fluid chamber 16 away from the bonded interface B1, except for at an additional bonded interface B2 discussed below. Fluid pressure within the first fluid chamber 16 thus reacts against the second bladder element 18A over the surface area of the second bladder element 18A exposed to the first fluid chamber 16. A compressive force F1 may also be applied to the bladder element 18A indirectly through the first bladder element 14 when a load is applied to the first bladder element 14.

The first feature 26 of the first bladder element 14 further comprises a second domed portion 26B of the second sheet 19B protruding outward from the first bladder element 14 and creating a second concavity 30B at the inner surface 24A of the first bladder element 14. The second feature 32 of the second bladder element 18A further comprises a second domed portion 32B that interfits with the second domed portion 26B of the first bladder element 14. The first domed portion 32A of the second bladder element 18A is cupped by the first domed portion 26A of the first bladder element 14 within the first concavity 30A. The second domed portion 32B of the second bladder element 18B is cupped by the second domed portion 26B of the first bladder element 14 within the second concavity 30B. The first feature 26, which includes the first and second domed portions 26A, 26B, thereby aligns the second bladder element 18A within the first fluid chamber 16 by interfitting with the second feature 32, which includes first and second domed portions 32A, 32B.

As is apparent in FIG. 1, the first bladder element 14 extends from the forefoot portion 13 to the heel portion 17. The second bladder element 18A is interfit with the first bladder element 14 so that it is positioned in the heel portion 17. The additional bladder element 18H is interfit with the first bladder element 14 so that it is positioned in the heel portion 17 adjacent the second bladder element 18A. Bladder element 18B is interfit with the first bladder element 14 so that it is positioned in the heel portion. Bladder elements 18C and 18D are interfit with the first bladder element 14 so that they are positioned in the midfoot portion. Bladder elements 18E, 18F, and 18G are interfit with the first bladder element 14 so that they are positioned in the forefoot portion 13.

Referring to FIG. 2, the fluid chamber 20H is sealed from both the first fluid chamber 16 and the second fluid chamber 20A. The bladder element 18H comprises an additional surface 34C having a third feature, which is an additional domed portion 32C. The first bladder element 14 further comprises a third domed portion 26C establishing a third central concavity 30C at the inner surface 24A of the first bladder element 14. The domed portion 32C of the bladder element 18H interfits with the first bladder element 14, as the domed portion 32C is cupped by the third domed portion 26C of the first bladder element 14 within the third central concavity 30C of the third domed portion 26C. An additional area A2 of the inner surface 24A of the first bladder element 14 and the outer surface 34C of the bladder element 18H at the cupped domed portion 32C establish an additional bonded interface B3. Similarly, the first bladder element 14 further comprises a fourth domed portion 26D establishing a fourth central concavity 30D at the inner surface 24A of the first bladder element 14. A domed portion 32D of the bladder element 18H interfits with the first bladder element 14, as a surface 34D of the domed portion 32D is cupped by the fourth domed portion 26D of the first bladder element 14 within the fourth central concavity 30D of the fourth domed portion 26D. The bladder element 18H is exposed to the first fluid chamber 16 away from the bonded interface B3 and a bonded interface B4. A load due to fluid pressure within the first fluid chamber 16 thus reacts against the bladder element 18H over the surface area of the bladder element 18H exposed to the first fluid chamber 16. A compressive force F2 may also be applied to the bladder element 18H indirectly through the first bladder element 14 when a load is applied to the first bladder element 14.

The cushioning dynamics and energy absorption of the cushioning assembly 12 is at least in part due to the selected steady-state fluid pressure in the first fluid chamber 16 and the selected steady-state fluid pressure in the second fluid chamber 20A. The steady-state fluid pressure is the fluid pressure when the cushioning assembly 12 is unloaded, such as when the article of footwear 10 is not in use. The steady-state fluid pressure is the respective inflation pressure of the fluid used to fill the fluid chambers 16, 20A. The relative pressures in the fluid chambers 16 and 20A affect dampening of the force F1 and can be selected (i.e., "tuned") to provide a desired cushioning response. For example, at least one of the first fluid chamber 16 and the second fluid chamber 20A can be pressurized above an ambient pressure when in an unloaded state. The ambient pressure is the pressure surrounding the first fluid chamber 14, external to the article of footwear 10. In one embodiment, the first fluid chamber 16 is at ambient pressure, and the second fluid chamber 20A is pressurized above ambient pressure. When a load is applied to the cushioning assembly 12, the fluid-pressure in the first bladder element 14 may provide an initial, relatively soft cushioning feel, with the higher pressure and therefore stiffer second bladder element 18A then providing an increased rate of dampening as bladder element 18A is compressed. Additionally, any or all of the fluid chambers 20A, 20B, 20C, 20D, 20E, 20F, 20G, and 20H of the various inner bladder elements 18A, 18B, 18C, 18D, 18E, 18F, 18G, and 18H can be pressurized at different pressures to affect the cushioning profile of the article of footwear 10. For example, fluid chambers 20E, 20F and 20G of the bladder elements 18D, 18E, and 18F in the forefoot portion 13 can be at different pressures than the fluid chambers 18A, 18B, 18H in the heel portion 17. Additionally, fluid chambers of bladder elements on the medial side 27, such as fluid chamber 20H of bladder element 18H can be at higher pressures than fluid chambers 20A, 20B, 20C, 20D, 20E, 20F and 20G of bladder elements 18A, 18B, 18C, 18D, 18E, 18F, and 18G on the lateral side 23.

Figure 21:
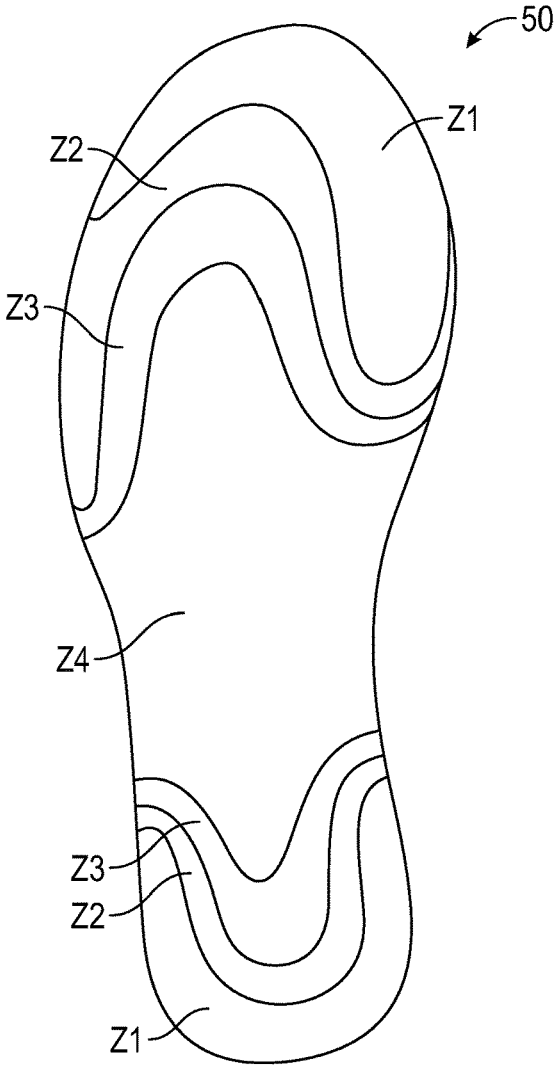
FIG. 21 is a schematic illustration of a predetermined map of pressures during wear testing of an article of footwear such as any of the articles of footwear of FIGS. 1-20.

In one embodiment, a pressure map 50 shown in FIG. 21 is a map of pressures applied during wear testing of a test article of footwear. For example, the pressures applied in a corresponding forefoot portion 13, midfoot portion 15, and heel portion 17 during wear of a test pair of the article of footwear 10 can be monitored and determined. The bladder elements 18A, 18B, 18C, 18D, 18E, 18F, 18G, 18H and any remaining inner bladder elements not visible in FIGS. 1-3 can then be inflated to pressurize the fluid chambers 20A, 20B, 20C, 20D, 20E, 20F, 20G, and 20H to respective pressures that correlate with pressures of the pressure map 50.

A method of manufacturing an article such as the article of footwear 10 may begin with forming the inner bladder elements 18A, 18B, 18C, 18D, 18E, 18F, 18G, and 18H, such as by any of blow-molding, thermoforming, or vacuum forming in mold assemblies. An inflation point, such as a fill tube, can be formed in each bladder element 18A, 18B, 18C, 18D, 18E, 18F, 18G, and 18H, as is understood by those skilled in the art. The bladder elements 18A, 18B, 18C, 18D, 18E, 18F, 18G, and 18H can then be inflated with fluid to establish the fluid chambers 20A, 20B, 20C, 20D, 20E, 20F, 20G, and 20H, at selected pressures.

Under the method, the pressure map 50 can be determined. The pressure map 50 of FIG. 21 shows various zones Z1, Z2, Z3, and Z4. Each zone Z1, Z2, Z3, and Z4 corresponds with a range of magnitudes of pressures experienced in the various portions 13, 15, and 17. Zone Z1 represents a first range of magnitudes of pressures. Zone Z2 represents a second range of magnitudes of pressures less than the first range of magnitudes of pressures. Zone Z3 represents a third range of magnitudes of pressures less than the second range of magnitudes of pressures. Zone Z4 represents a fourth range of magnitudes of pressures less than the third range of magnitudes of pressures. The fluid chambers 20A, 20B, 20C, 20D, 20E, 20F, 20G, and 20H can be inflated to respective pressures that correlate with the pressure map 50. For example, the fluid chamber 20G may be inflated to a greater pressure than either of the second fluid chamber 18A and the first fluid chamber 14 when the article of footwear 10 is in an unloaded state.

Next, the first and second polymeric sheets 19A, 19B used to form the first bladder element 14 can be inserted into mold halves of a mold assembly. The first bladder element 14 can then be formed by thermoforming and vacuum forming, causing the first and second polymeric sheets 19A, 19B to conform to mold surfaces of the mold assembly, creating the domed portions 26A, 26B, 26C, 26D. The mold assembly is configured with mold surfaces so that the first and second polymeric sheets 19A, 19B will have domed portions 26A, 26B, 26C, 26D.

The method may also comprise interfitting the first feature 26 of the first bladder element 14 with the second feature 32 of the second bladder element 18A so that a first area A1 of an inner surface 24A of the first bladder element 14 is aligned with a first area C of an outer surface 28A of the second bladder element 18A and the second bladder element 18A is within a first fluid chamber 16. This interfitting may include cupping the first domed portion 32A of the second bladder element 18A by the first domed portion 26A of the first bladder element 14 within the first concavity 30A. The interfitting of the first bladder element 14 with the second bladder element 18A may further include cupping the second domed portion 32B of the second bladder element 18A by the second domed portion 26B of the first bladder element 14 within the second concavity 30B. The interfitting of the first feature 26 and the second feature 32 aligns the second bladder element 18A within the first bladder element 14. The interfitting may be accomplished simultaneously with the forming of the first feature 26, or may be accomplished subsequent to forming the first feature 26. For example, if the first and second polymeric sheets 19A, 19B are relatively hot after thermoforming, the bladder element 18A can be positioned in the mold assembly interfit with the feature 26 after the feature 26 is formed.

When the first bladder element 14 is interfit with the second bladder element 18A as described, the first area A1 of the inner surface 24A of the first bladder element 14 is then bonded to the first area C of the outer surface 28A of the second bladder element 18A to establish the bonded interface B1. The bonding may be by any or all of thermal fusion, by compression, or by adhesives. The additional bladder elements 18B, 18C, 18D, 18E, 18F, 18G, and 18H are similarly bonded to the first bladder element 14 when interfit with additional domed portions or the sheets 19A, 19B as the elevated temperature of the sheets 19A, 19B during thermoforming causes them to thermally bond to the bladder elements 18B, 18C, 18D, 18E, 18F, 18G, and 18H at certain locations of the outer surfaces of the bladder elements 18B, 18C, 18D, 18E, 18F, 18G, and 18H.

The peripheral flanges 21A, 21B can be secured by any of thermal bonding during thermoforming, compression of the mold assembly during thermoforming, or by radio frequency welding or adhesive, to seal the first fluid chamber 16, with an inflation point such as a fill tube allowing fluid communication with the chamber 16. The first fluid chamber 16 can then be inflated, or left at ambient pressure, and any fill tube is plugged.

Next, the cushioning assembly 12 can be secured to an upper 56. The upper 56 can be secured to the cushioning assembly 12 by various methods, such as by adhesive bonding, stitching, radio frequency welding, thermal bonding, by a combination of these methods, or otherwise. The upper 56 can include a strobel unit that can overlay and be adhered to the upper surface cushioning assembly 12. A midsole layer 57 is secured to an upper surface of the bladder element 14. The midsole layer 57 may be an ethylene vinyl acetate (EVA) foam, or another type of cushioning material, that is in turn secured to the upper 56. Alternatively, the upper surface of the bladder element 14 can be secured directly to the upper 56 without a midsole layer.

An outsole 58 may be secured to the cushioning assembly 12. The outsole 58 can be a single, continuous, integral component that covers the entire ground-facing surface of the cushioning assembly 12. Alternatively, discrete outsole elements can be secured at different areas of the ground-facing surface of the cushioning assembly 12. The outsole 58 can be a high wear material, such as a durable rubber.

Figure 4:
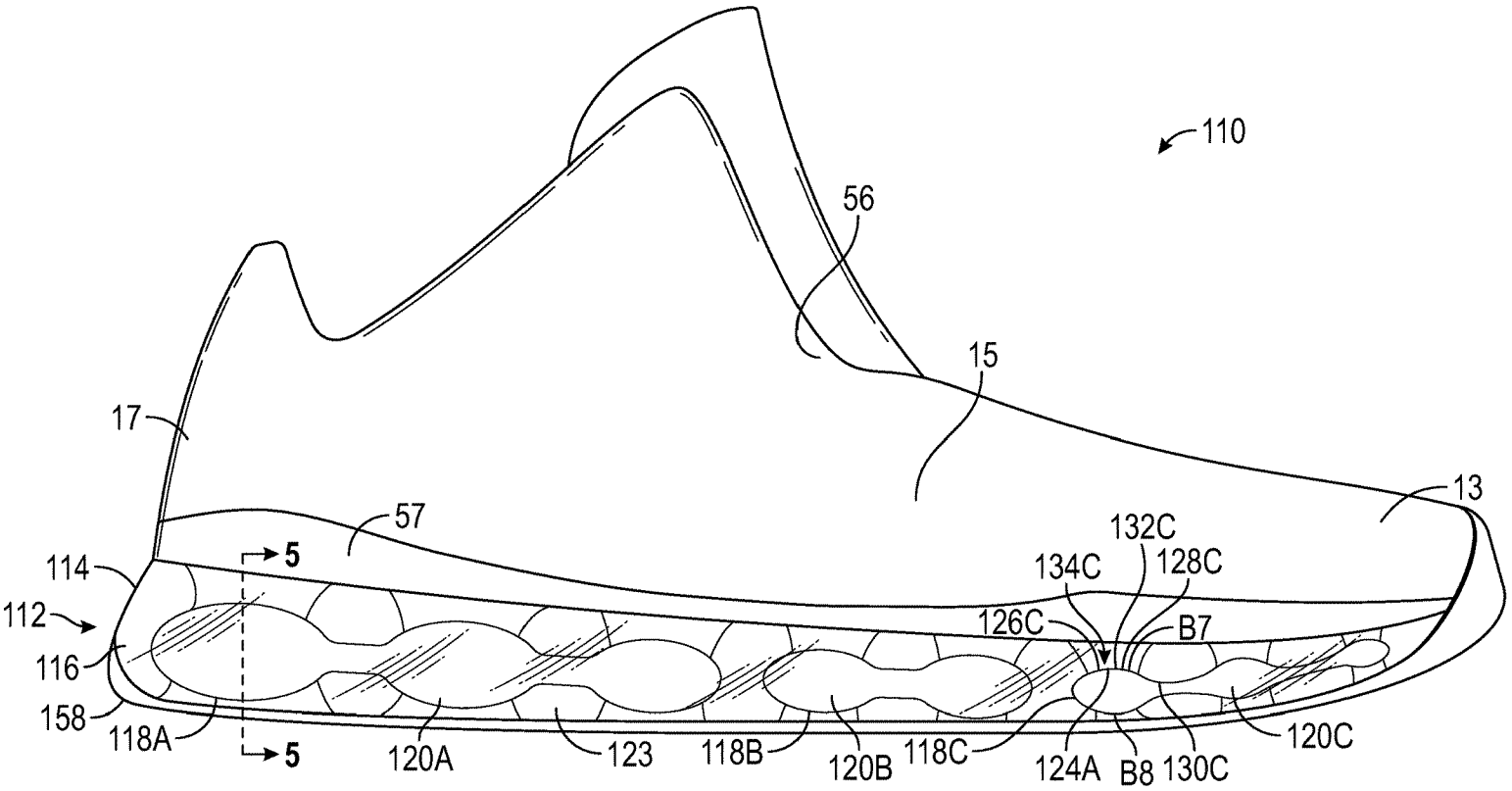
FIG. 4 is a schematic illustration in side view of another embodiment of an article of footwear including a cushioning assembly in accordance with an alternative aspect of the present teachings.
Figure 5:
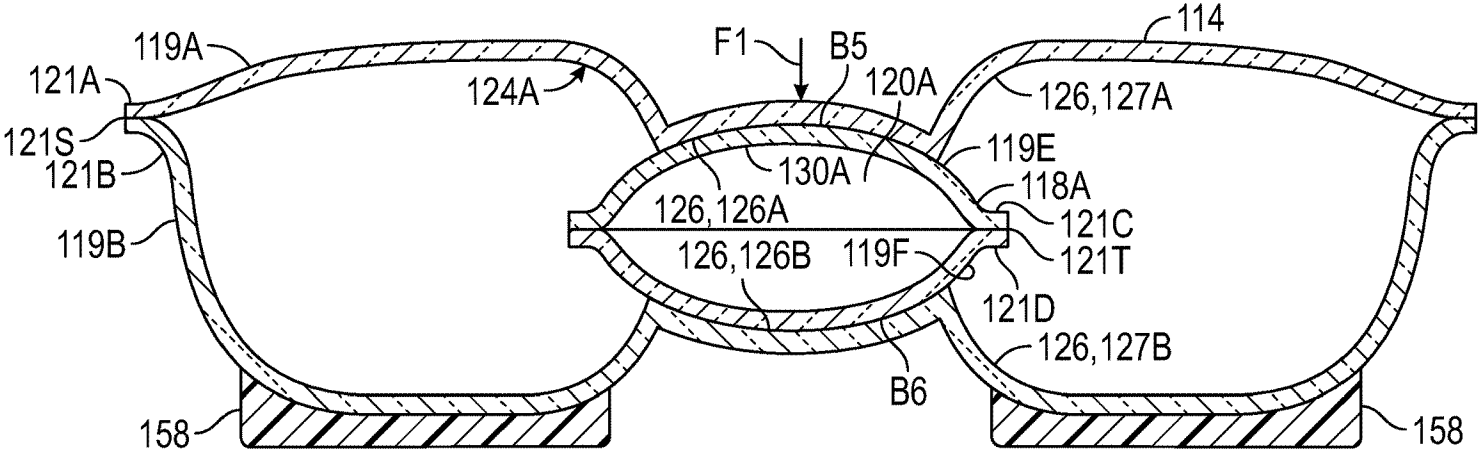
FIG. 5 is a schematic illustration in cross-sectional view of the cushioning assembly of FIG. 4 taken at lines 5-5 in FIG. 4.
Figure 6:
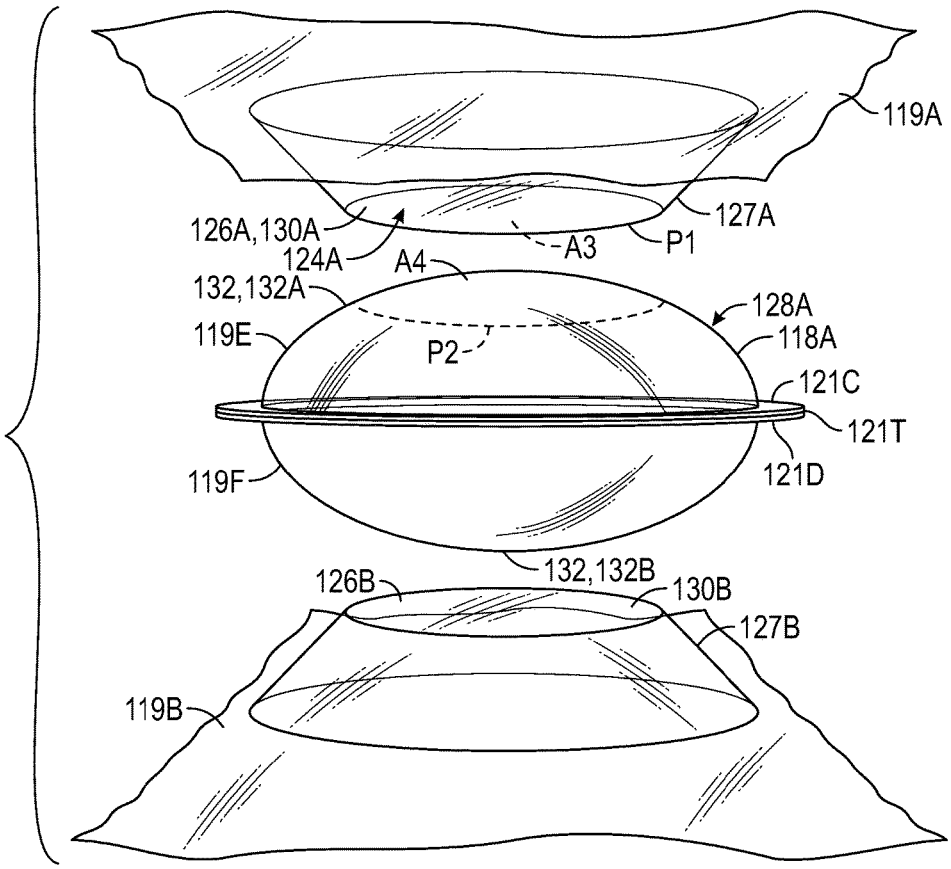
FIG. 6 is a schematic perspective illustration in exploded fragmentary view of a portion of the cushioning assembly of FIG. 4.

FIGS. 4-6 show another embodiment of an article of footwear 110 with a cushioning assembly 112. Like cushioning assembly 12, the cushioning assembly 112 also has multiple fluid-filled bladder elements, including a first bladder element 114 forming a first fluid chamber 116, and multiple additional bladder elements 118A, 118B, and 118C, also referred to as inner bladder elements, each forming a respective fluid chamber 120A, 120B, and 120C that is sealed from the first fluid chamber 116. Bladder element 118A may be referred to as a second bladder element. Due to this arrangement, the first bladder element 114 is referred to as the outer bladder element, and the second bladder element 118A as well as bladder elements 118B, 118C are referred to as inner bladder elements. FIGS. 4 and 5 show only the inner bladder elements 118A, 118B, and 118C, visible on the lateral side 123 and from the rear of the article of footwear 110. Still more additional bladder elements may be arranged on the medial side of the article of footwear 110, not visible in FIG. 4. Any or all of the bladder elements 114, 118A, 118B, 118C, can be formed from the same material as described with respect to the bladder elements 14, 18A of the cushioning assembly 12 of FIG. 1.

The first bladder element 114 may be formed from a first polymeric sheet 119A and the second polymeric sheet 119B each having a respective peripheral flange 121A, 121B. The peripheral flanges 121A, 121B are secured to one another at a peripheral seam 121S to seal and define the first fluid chamber 116. The peripheral flanges 121A, 121B are secured to one another by any of adhesive, thermal bonding during thermoforming, compression during thermoforming, radio frequency welding or other methods so that the joined peripheral flanges 121A, 121B form the peripheral seam 121S that surrounds the first bladder element 114 and seals the first fluid chamber 116.

The bladder element 114 is referred to as a full length bladder element as it extends from the forefoot portion 13 over the midfoot portion 15 to the heel portion 17 of the article of footwear 110. The first bladder element 114 is secured to the upper 56 either directly or indirectly via a midsole 57 as described with respect to the article of footwear 10. An outsole 158 similar to outsole 58 is secured to the second sheet 119B of the first bladder element. The outsole 158 has discontinuous portions or elements, as shown in FIG. 5.

As shown in FIG. 4, each of the bladder elements 118A, 118B, 118C has multiple domed portions spaced longitudinally and fluidly interconnected with one another. Each bladder element 118A, 118B, 118C may also have additional domed portions in fluid communication with and spaced laterally from those visible in FIG. 4.

With reference to FIGS. 5 and 6, a first sheet 119A of the first bladder element 114 comprises an inner surface 124A having a first feature 126. The first feature 126 includes a first inward protrusion 127A of the inner surface 124A and a first central domed portion 126A protruding outward from and surrounded by the first inward protrusion 127A. The first central domed portion 126A is a formed geometrical shape that protrudes outward from the first bladder element 114 creating a first concavity 130A at the inner surface 124A of the first bladder element 114.

The first feature 126 of the first bladder element 114 further comprises a second inward protrusion 127B of the inner surface 124A of the first bladder element 114. The second inward protrusion 127B is in the second sheet 119B of the first bladder element 114. The first feature 126 further includes a second central domed portion 126B protruding outward from and surrounded by the second inward protrusion 127B.

The second bladder element 118A may be formed from a first polymeric sheet 119E bonded to a second polymeric sheet 119F at respective peripheral flanges 121C, 121D secured to one another at a peripheral seam 121T to seal and define the second fluid chamber 120A. The peripheral flanges 121C, 121D are secured to one another by any of adhesive, thermal bonding during thermoforming, compression during thermoforming, radio frequency welding or other methods. As shown in FIG. 6, the first polymeric sheet 119E of the second bladder element 118A comprises an outer surface 128A having a second feature 132. The second feature 132 of the second bladder element 118A includes a first domed portion 132A. The first domed portion 132A and the first central domed portion 126A are configured so that the first domed portion 132A is cupped by the first central domed portion 126A within the first concavity 130A. In this manner, a first area A3 of the inner surface 124A is aligned with a first area A4 of the outer surface 128A of the second bladder element 118A at a bonded interface B5. The first area A3 is bounded by perimeter P1. The first area A4 is bounded by a perimeter P2 and is the area covered by and in contact with the first domed portion 126A. Similarly, the second feature 132 of the second bladder element 118A comprises a second domed portion 132B that is cupped by the second central domed portion 126B of the first bladder element 114 within a second concavity 130B of the second central domed portion 126B. The second domed portion 132B is bonded to the second concavity 130B at a bonded interface B6.

The second bladder element 118A is exposed to the first fluid chamber 116 away from the bonded interfaces B5, B6. A load due to fluid pressure within the first fluid chamber 116 thus reacts against the second bladder element 118A over the surface area of the second bladder element 118A exposed to the first fluid chamber 116. A compressive force F1 may also be applied to the bladder element 118A indirectly through the first bladder element 114 when a load is applied to the bladder element 114.

As shown in FIG. 4, the bladder element 118C comprises an additional surface 134C having a third feature that is an additional domed portion 132C. The bladder element 118C may be referred to as a third bladder element. The first feature 126 of the first bladder element 114 further comprises a third domed portion 126C establishing a third central concavity 130C at the inner surface of the first bladder element 114. The additional domed portion 132C of the third bladder element 118C is cupped by the third domed portion 126C of the first bladder element 114 within the third central concavity 130C. The first feature 126 thus further interfits with the third feature 132C such that an additional area of the inner surface 124A of the first bladder element 114 and the outer surface 128C of the third bladder element 118C establish an additional bonded interface B7. A lower side of the first bladder element 114 and the third bladder element 118 are arranged symmetrically to the configuration described, so that the first bladder element 114 and the third bladder element 118C interfit at a lower side in FIG. 4 to establish a bonded interface B8. The third bladder element 118C is exposed to the first fluid chamber 116 away from the additional bonded interfaces B7, B8.

As described with respect to the article of footwear 10, each of the bladder elements 114, 118A, 118B, and 118C may be inflated to have different pressures corresponding to a predetermined pressure map 50 of FIG. 21. For example, the third fluid chamber 120C may have a greater pressure than either of the second fluid chamber 118A and the first fluid chamber 116 when the article of footwear 110 is in an unloaded state.

Figure 7:
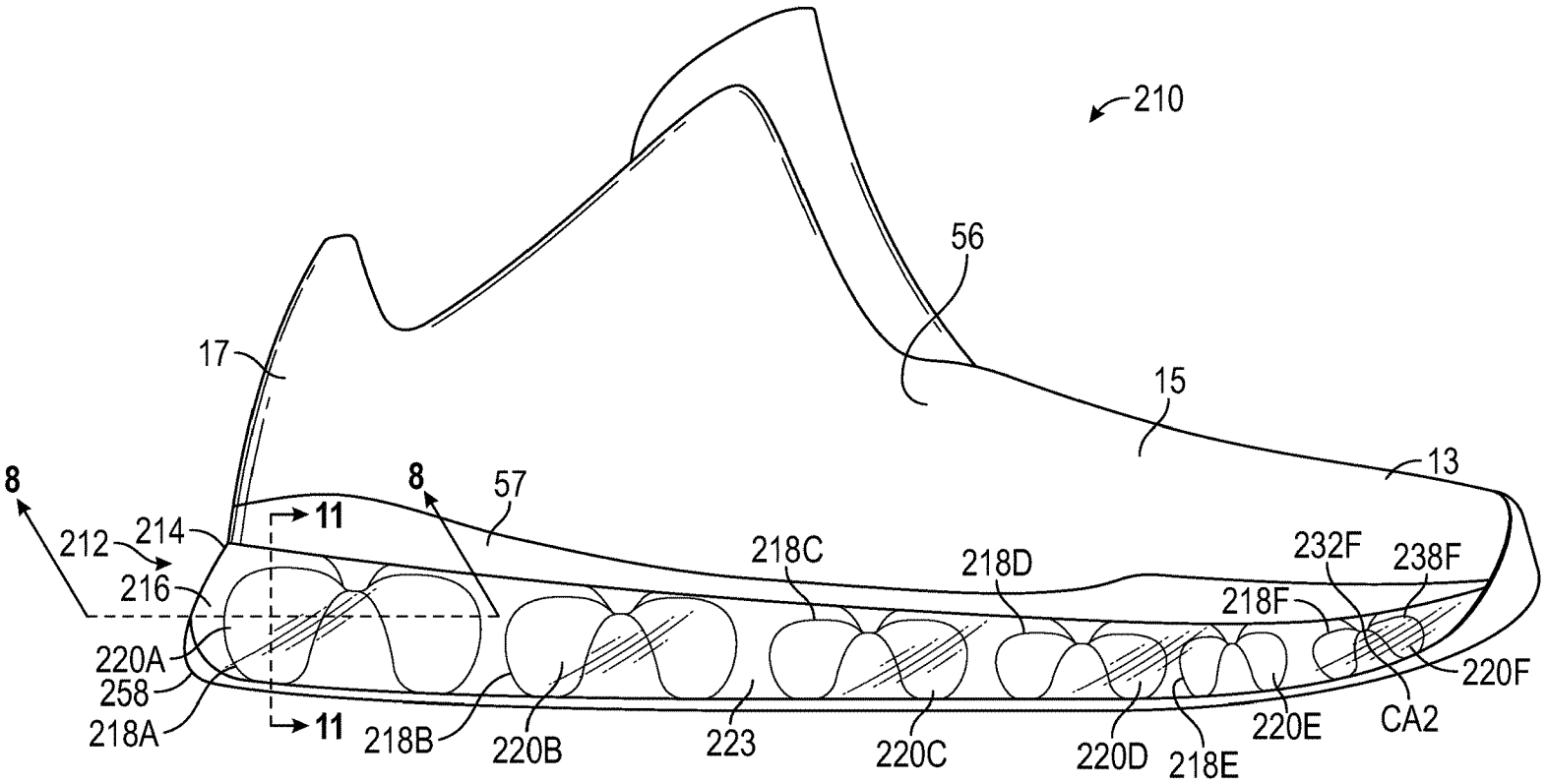
FIG. 7 is a schematic illustration in side view of another embodiment of an article of footwear including a cushioning assembly in accordance with an alternative aspect of the present teachings.

FIG. 7 shows an article of footwear 210 with an alternative cushioning assembly 212. Like cushioning assembly 12, the cushioning assembly 212 also has multiple fluid-filled bladder elements, including a first bladder element 214 forming a first fluid chamber 216, and multiple additional bladder elements 218A, 218B, 218C, 218D, 218E, and 218F also referred to as inner bladder elements, each forming a respective fluid chamber 220A, 220B, and 220C, 220D, 220E, and 220F that is sealed from the fluid chamber 216. Due to this arrangement, the first bladder element 214 is referred to as the outer bladder element, and the second bladder element 218A as well as bladder elements 218B, 218C, 218D, 218E, and 218F are referred to as inner bladder elements. FIG. 7 shows only the inner bladder elements 218B, 218C, 218D, 218E, and 218F, visible on the lateral side 223 of the article of footwear 110. Still more additional bladder elements may be arranged on the medial side of the article of footwear 210, not visible in FIG. 8. Any or all of the bladder elements 214, 218A, 218B, 218C, 218D, 218E, and 218F can be formed from any of the same materials as described with respect to the bladder elements 14, 18A of the cushioning assembly 12 of FIG. 1.

The bladder element 214 is referred to as a full length bladder element as it extends from the forefoot portion 13 over the midfoot portion 15 to the heel portion 17 of the article of footwear 210. The first bladder element 214 is secured to the upper 56 either directly or indirectly via a midsole 57 as described with respect to the article of footwear 10. An outsole 258, similar to outsole 58, is secured to a second polymeric sheet 219B of the first bladder element 214. The outsole 258 has discontinuous portions or elements, as shown in FIG. 8.

Figure 11:
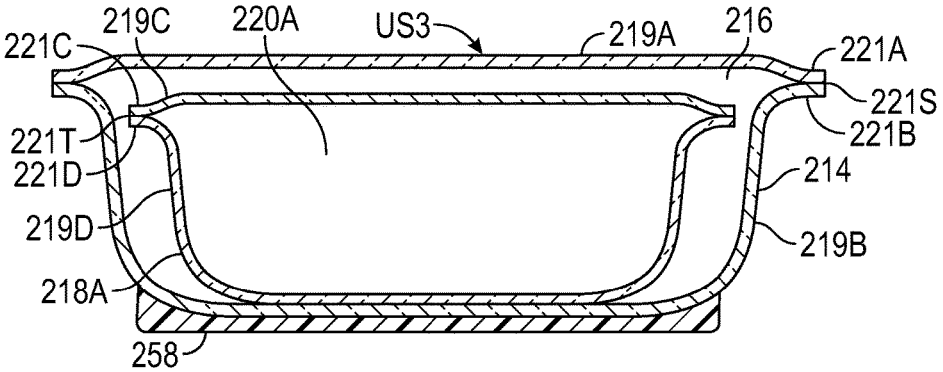
FIG. 11 is a schematic illustration in cross-sectional view of the cushioning assembly of FIG. 7 taken at lines 11-11 in FIG. 7.

As shown in FIG. 11, the first bladder element 214 is formed from a first polymeric sheet 219A secured to the second polymeric sheet 219B at respective peripheral flanges 221A, 221B of the sheets 219A, 219B, forming a peripheral seam 221S. The second bladder element 218A may also be formed from a first polymeric sheet 219C and a second polymeric sheet 219D secured to one another at respective peripheral flanges 221C, 221D forming a peripheral seam 221T to seal the second fluid chamber 220A.

Figure 8:
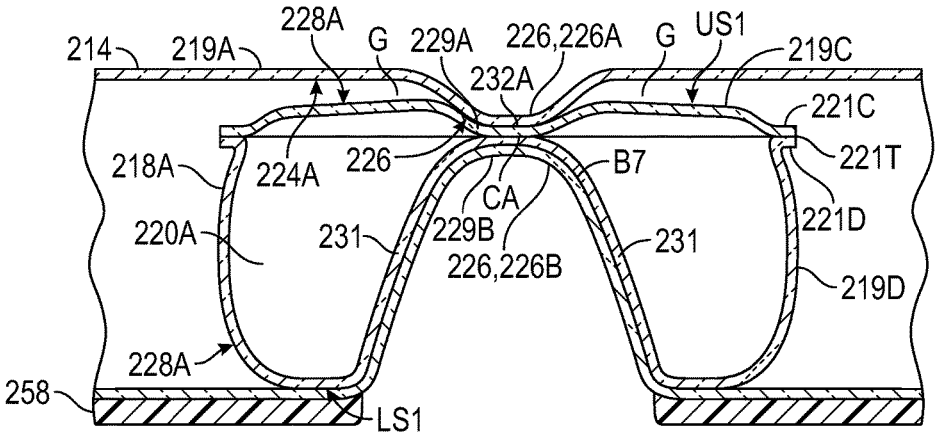
FIG. 8 is a schematic illustration in fragmentary cross-sectional view of a portion of the cushioning assembly of FIG. 7 taken at lines 8-8 in FIG. 7.

With reference to FIG. 8, the first sheet 219A of the first bladder element 214 comprises an inner surface 224A having a first feature 226. The first feature 226 includes a recess 226A in the first sheet 219A and an opposing recess 226B in the second sheet 219B causing inward protrusions of the inner surface 224A. The second bladder element 218A comprises an outer surface 228A having a second feature 232A. The second feature 232A is opposing portions 229A, 229B of the second bladder element 218A that are bonded to one another at a central area CA of the second bladder element 218A. The central area CA is surrounded by the second fluid chamber 220A such that the second fluid chamber 220A is annular. The first feature 226 interfits with the second feature 232A such that a first area of the inner surface 224A of the first bladder element 214 is aligned with a first area of the outer surface 228A of the second bladder element 218A at a bonded interface B6 and with the second area of the outer surface 228A at portion 229B at a bonded interface B7. The bonded interface B7 extends along the entire inner wall 231 of the second bladder element 218A. The outer surface 228A of the second bladder element 218A is exposed to the first fluid chamber 216 away from the bonded interfaces B6, B7.

Figure 9:
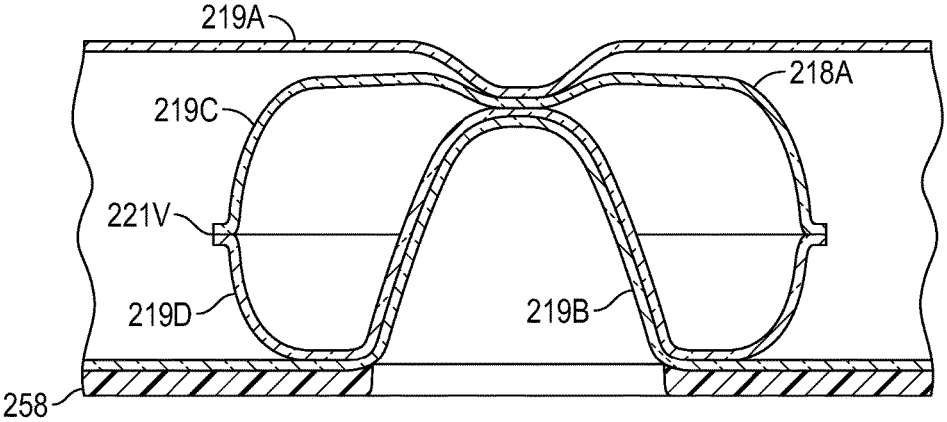
FIG. 9 is a schematic illustration in fragmentary cross-sectional view of a portion of the cushioning assembly of FIG. 7 configured with an alternative peripheral flange.
Figure 10:
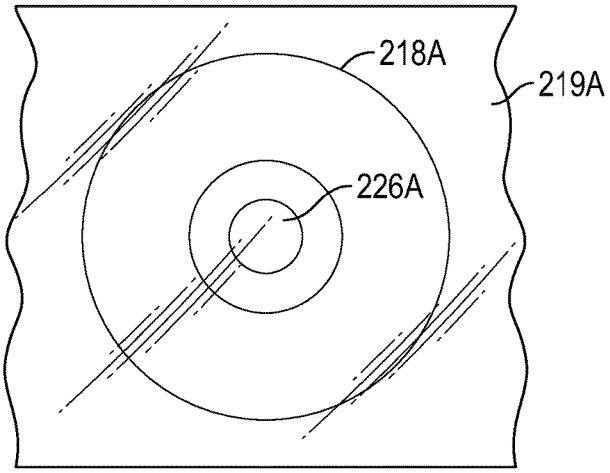
FIG. 10 is a schematic illustration in top view of the portion of the cushioning assembly of FIG. 8.

As shown in FIG. 8, the first and second bladder elements 214, 218A define a gap G around the first feature 226 and around the central area CA between the second bladder element 218A and the first bladder element 214. Stated differently, the first fluid chamber 216 extends above the second bladder element 218A except at the central area CA. The peripheral seam 221T, the central area CA and the bonded interface B7 are displaced or biased upward. That is, the bladder element 218A is formed so that the peripheral seam 221T, the central area CA and the bonded interface B7 are nearer an upper surface US1 of the bladder element 218A than a lower surface LS1 of the bladder element 218A. Similarly, the peripheral seam 221S is displaced or biased toward the upper surface US3 of the first sheet 219A as shown in FIG. 11. The bladder elements 214 and 218A may have different deformation characteristics than if the seams 221S, 221T were centrally positioned, as lateral deformation tends to be limited at the seams 221S, 221T. The displacement or biasing of the flanges 221C, 221D and 221A, 221B, rather than positioned midway between the upper surface and the lower surface, enables the cushioning assembly 12 to be secured in the article of footwear 10 and with the seam 221S generally covered by the upper 56. FIG. 9 shows an alternative arrangement with the second bladder element 218A formed so that a peripheral seam 221V is centrally located.

Bladder element 218F may be referred to as a third bladder element. As shown in FIG. 7, bladder element 218F comprises an additional surface 238F having a third feature that is opposing portions of the third bladder element 218F that are bonded to one another at a central area CA2 of the third bladder element 218F similarly to the central area CA of bladder element 218A. The first feature 226 of the first bladder element 214 further includes a recessed portion 232F that interfits with the third feature such that an additional area of the inner surface of the first bladder element 214 and the outer surface of the third bladder element 218F establish an additional bonded interface as shown in FIG. 7, similar to the bonded interface B7 of the bladder element 218A and bladder element 214, and the third bladder element 218F is exposed to the first fluid chamber away from the additional bonded interface. Each of the remaining inner bladder elements 218B, 218C, 218D, and 218E are similarly arranged.

As described with respect to the article of footwear 10, each of the bladder elements 214, 218A, 218B, 218C, 218D, 218E, and 218F may be inflated to have different pressures corresponding to the pressure map 50. For example, the third fluid chamber 220F may have a greater pressure than either of the second fluid chamber 220A and the first fluid chamber 216 when the article of footwear 210 is in an unloaded state.

Figure 12:
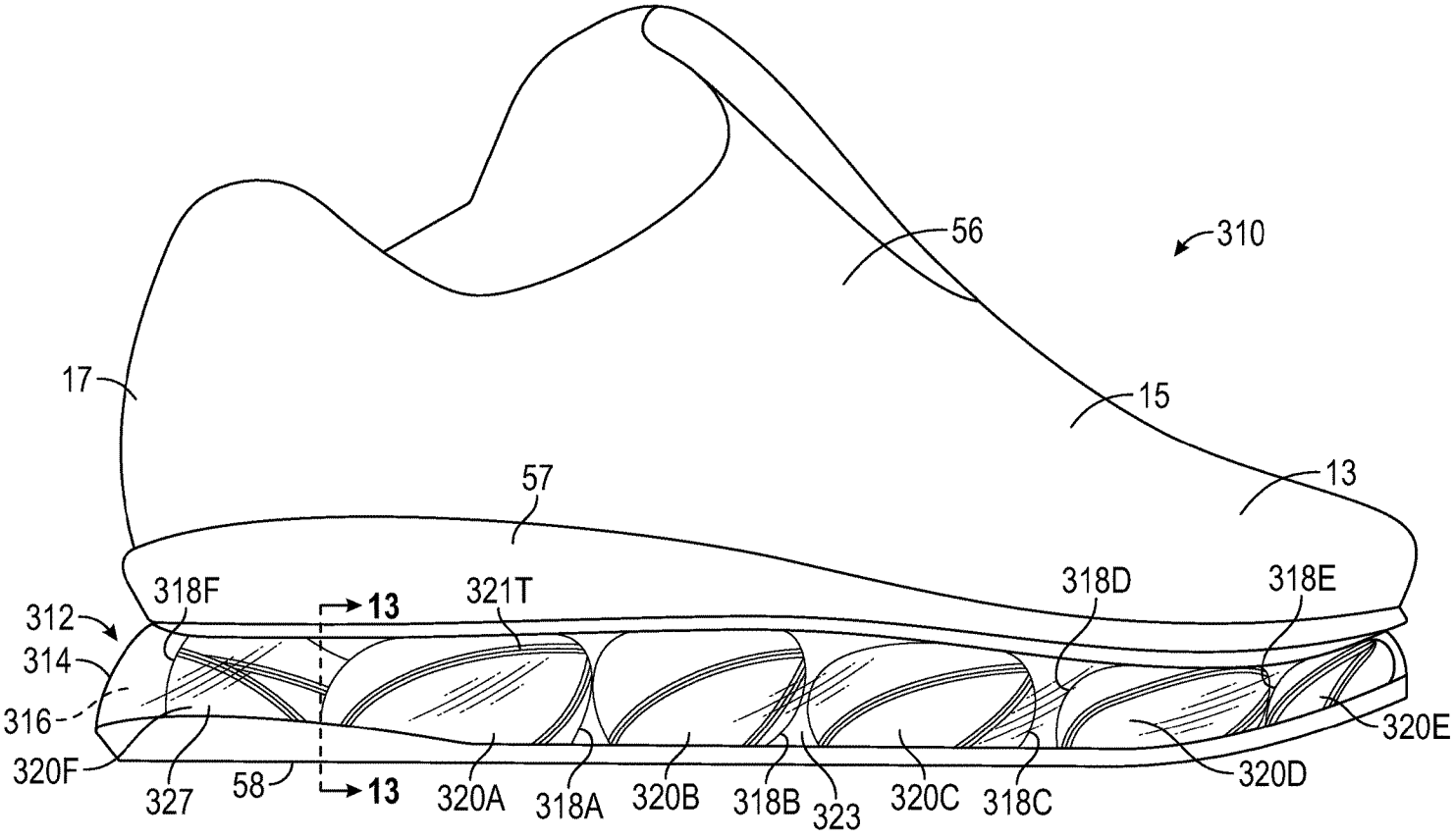
FIG. 12 is a schematic illustration in side view of another embodiment of an article of footwear including a cushioning assembly in accordance with an alternative aspect of the present teachings.

FIG. 12 shows an article of footwear 310 with an alternative cushioning assembly 312. Like cushioning assembly 12, the cushioning assembly 312 also has multiple fluid-filled bladder elements, including a first bladder element 314 forming a first fluid chamber 316, and multiple additional bladder elements 318A, 318B, 318C, 318D, 318E, and 318F also referred to as inner bladder elements, each forming a respective fluid chamber 320A, 320B, and 320C, 320D, 320E, and 320F that is sealed from the fluid chamber 316. Due to this arrangement, the first bladder element 314 is referred to as the outer bladder element, and the second bladder element 318A as well as bladder elements 318B, 318C, 318D, 318E, and 318F are referred to as inner bladder elements. FIG. 12 shows only the inner bladder elements 318B, 318C, 318D, 318E, and 318F, visible on the lateral side 323 and from the rear 327 of the article of footwear 310. Still more additional bladder elements may be arranged on the medial side of the article of footwear 310, not visible in FIG. 12. Any or all of the bladder elements 314, 318A, 318B, 318C, 318D, 318E, and 318F can be formed from the same material as described with respect to the bladder elements 14, 18A of the cushioning assembly 12 of FIG. 1.

The bladder element 314 is referred to as a full length bladder element as it extends from the forefoot portion 13 over the midfoot portion 15 to the heel portion 17 of the article of footwear 310. The first bladder element 314 is secured to the upper 56 either directly or indirectly via a midsole layer 57 as described with respect to the article of footwear 10. An outsole 58 is secured to a second polymeric sheet 319B of the first bladder element 314.

Figure 13:
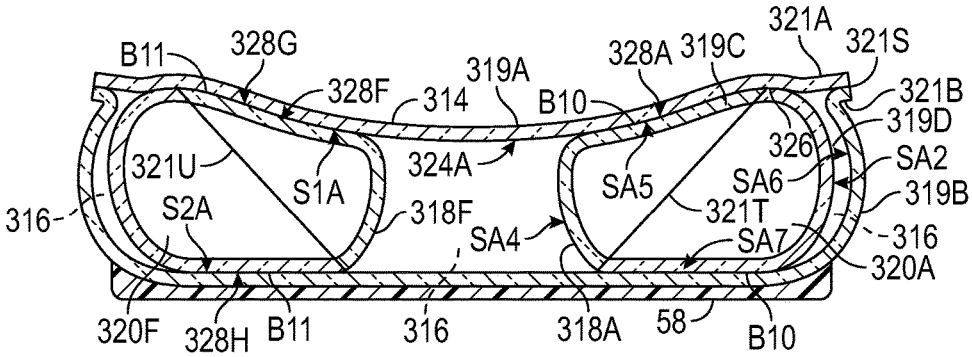
FIG. 13 is a schematic illustration in cross-sectional view of the cushioning assembly of FIG. 12 taken at lines 13-13 in FIG. 12.
Figure 14:
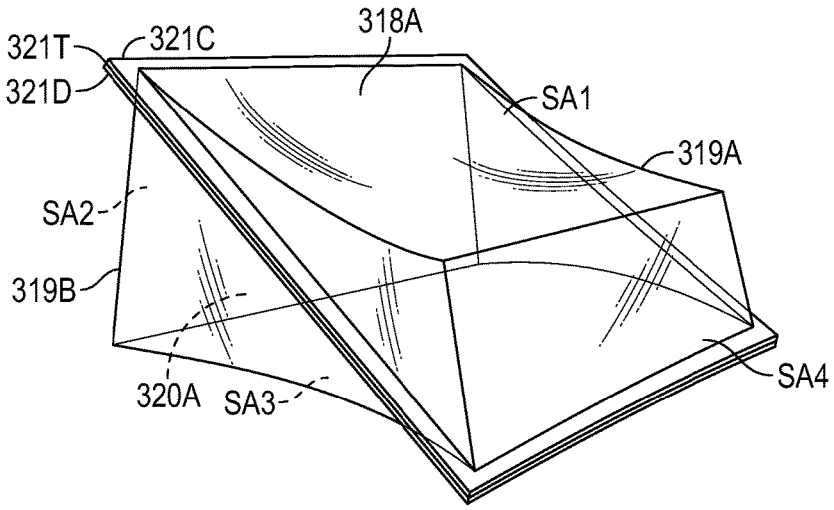
FIG. 14 is a schematic illustration in perspective view of an inner bladder element of the cushioning assembly of FIG. 12 in a partially inflated state.

As best shown in FIG. 13, the first bladder element 314 is formed from a first polymeric sheet 319A secured to the second polymeric sheet 319B at respective peripheral flanges 321A, 321B of the sheets 319A, 319B, forming a peripheral seam 321S. The second bladder element 318A may also be formed from a first polymeric sheet 319C and a second polymeric sheet 319D secured to one another at respective peripheral flanges 321C, 321D forming a peripheral seam 321T that surrounds the second bladder element 318A and seals the second fluid chamber 320A. FIG. 14 is a perspective view in a direction generally rearward from the forefoot portion 13 of the second bladder element 318A before inflation of the second bladder element 318A. FIG. 13 shows the second bladder element 318A in a cross-sectional view in a forward direction. In both views, the peripheral seam 321T inclines in a laterally outward direction.

With reference to FIG. 13, the first sheet 319A of the first bladder element 314 comprises an inner surface 324A having a first feature 326. The first feature 326 is the formed shape of the inner surface 324A that interfits with a shape of an outer surface 328A of the inflated second bladder element 318A. The inner surface 324A of the first bladder element 314 interfits with the outer surface 328A of the second bladder element 318A such that a first area of the inner surface 324A of the first bladder element 314 is aligned with a first area of the outer surface 328A of the second bladder element 318A at a bonded interface B10. The first area of the outer surface 328A is the area including surfaces SA1 and SA3 indicated in FIG. 14. The first area of the inner surface 324A is the area including surfaces SA5 and SA7 in contact with surfaces SA1 and SA3, respectively and forming the bonded interface B10. The surfaces SA2 and SA6 are not in contact with one another as formed and in the absence of at least predetermined load.

The area at surfaces SA2 and SA4 of bladder element 318A is exposed to the first fluid chamber 316 and is away from the bonded interface B10. The bonded interface B10 is disposed on opposing portions of the inner surface 324A of the first bladder element 314. For example, upper surface SA5 and lower surface SA7 are opposing portions of the inner surface 324A. The second bladder element 318A is positioned in the first bladder element 314 so that the peripheral flanges 321C, 321D and the peripheral seam 321T incline within the first bladder element 314 from the lower surface SA5 to the upper surface SA7. The flanges 321C, 321D and the peripheral seam 321T thereby function as a tether that further anchors the opposing surfaces SA5 and SA7 to one another and control resulting deformation of the cushioning assembly 312 under loading. Lateral or shear forces resulting from a downward compressive force on the outer surface of the bladder element 314 act on the inner bladder element 318A and are directed by the peripheral seam 321T and flanges 321C, 321D to the surfaces SA5, SA7.

Bladder element 318F may be referred to as a third bladder element. As shown in FIG. 13, bladder element 318F comprises an additional surface 328F with a third feature which includes opposing surfaces 328G, 328H of the third bladder element 318F that are bonded to the inner surface 324A of bladder element 314 as explained with respect to bladder element 318A. The first feature 326 further includes the formed shape of the inner surface 324A that further interfits with a shape of the outer surface 328F of the inflated third bladder element 318F such that an additional area S1A and S2A of the inner surface 324A of the first bladder element 314 and the area of the surface 328G, which is a portion of the outer surface 328F of the third bladder element 318F establish an additional bonded interface B11 as shown in FIG. 13. The third bladder element 318F is exposed to the first fluid chamber 316 away from the additional bonded interface B11. The third bladder element 318F also is formed from formed sheets secured to one another at peripheral flanges forming a peripheral seam 321U that inclines laterally outward in the article of footwear 310 as discussed with respect to bladder element 318A. Each of the remaining inner bladder elements 318B, 318C, 318D, and 318E are similarly configured and arranged.

As described with respect to the article of footwear 10, each of the bladder elements 314, 318A, 318B, 318C, 318D, 318E, and 318F may be inflated to have different pressures corresponding to the pressure map 50 (see FIG. 21). For example, the third fluid chamber 320F may have a greater pressure than either of the second fluid chamber 320A and the first fluid chamber 316 when the article of footwear 310 is in an unloaded state. Similarly, bladder element 318E may also be referred to as a third bladder element, and the fluid chamber 320E of bladder element 318E in the forefoot portion 13 may have a greater pressure than either of the second fluid chamber 320A and the first fluid chamber 316 when the article of footwear 310 is in an unloaded state.

Figure 15:
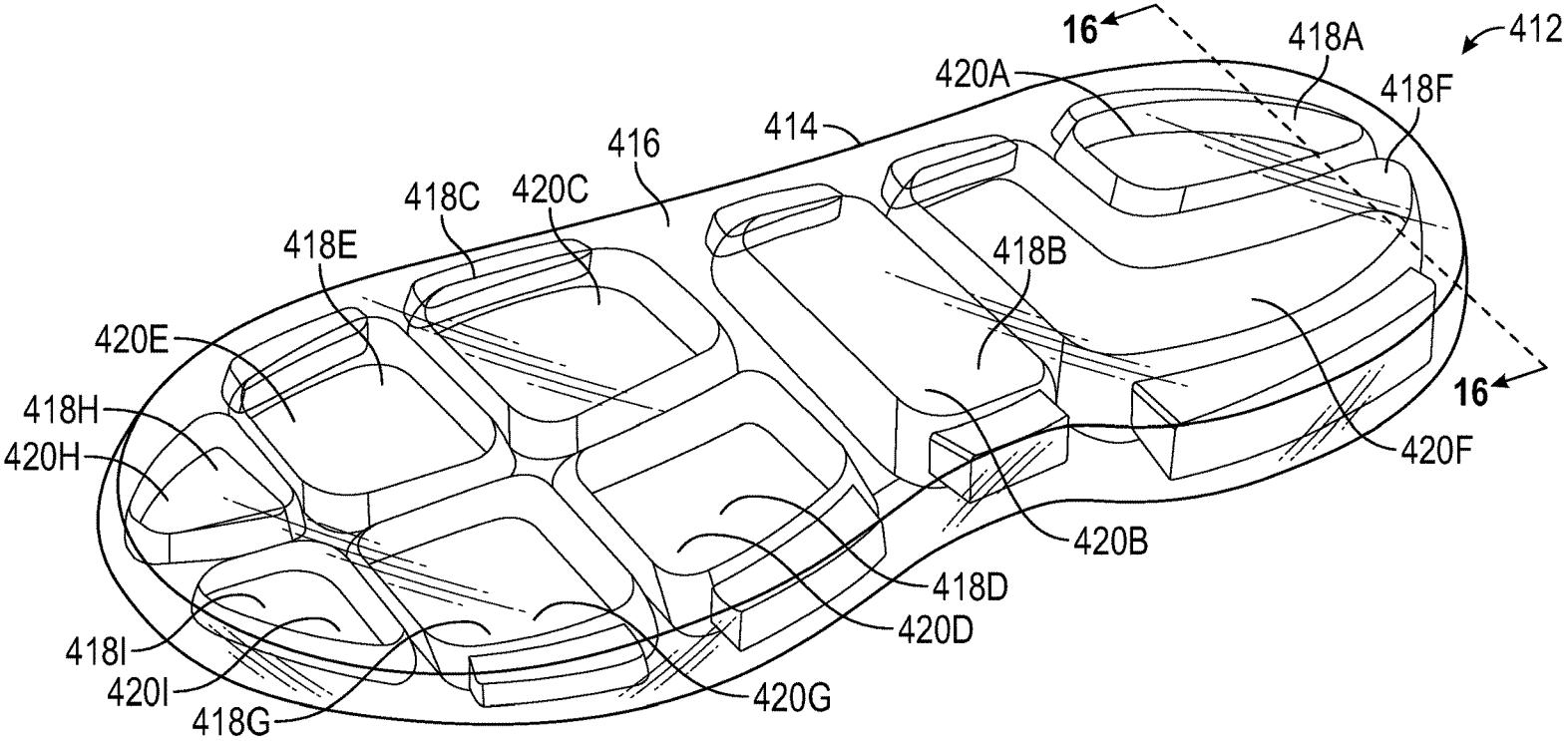
FIG. 15 is a schematic illustration in perspective view of another embodiment of a cushioning assembly in accordance with an alternative aspect of the present teachings.

FIG. 15 shows alternative cushioning assembly 412 that may be used in any of the articles of footwear 10, 110, 210, or 310. Like cushioning assembly 12, the cushioning assembly 412 also has multiple fluid-filled bladder elements, including a first bladder element 414 forming a first fluid chamber 416, and multiple additional bladder elements 418A, 418B, 418C, 418D, 418E, 418F, 418G, 418H, and 418I also referred to as inner bladder elements, each forming a respective fluid chamber 420A, 420B, 420C, 420D, 420E, 420F, 420G, 420H, and 420I that is sealed from the fluid chamber 416. Due to this arrangement, the first bladder element 414 is referred to as the outer bladder element, and the second bladder element 418A as well as bladder elements 418B, 418C, 418D, 418E, 418F, 418G, 418H and 418I are referred to as inner bladder elements. Any or all of the bladder elements 414, 418A, 418B, 418C, 418D, 418E, 418F, 418G, 418H and 418I can be formed from any of the same materials as described with respect to the bladder elements 14, 18A of the cushioning assembly 12 of FIG. 1.

The first bladder element 414 is referred to as a full length bladder element as it extends from the forefoot portion 13 over the midfoot portion 15 to the heel portion 17 when used in the article of footwear 10 of FIG. 1. The first bladder element 414 may be secured to the upper 56 of FIG. 1 either directly or indirectly via the midsole layer 57 as described with respect to the article of footwear 10. The outsole 58 as shown in FIG. 1 may be secured to a second polymeric sheet 419B of the first bladder element.

Figure 16:
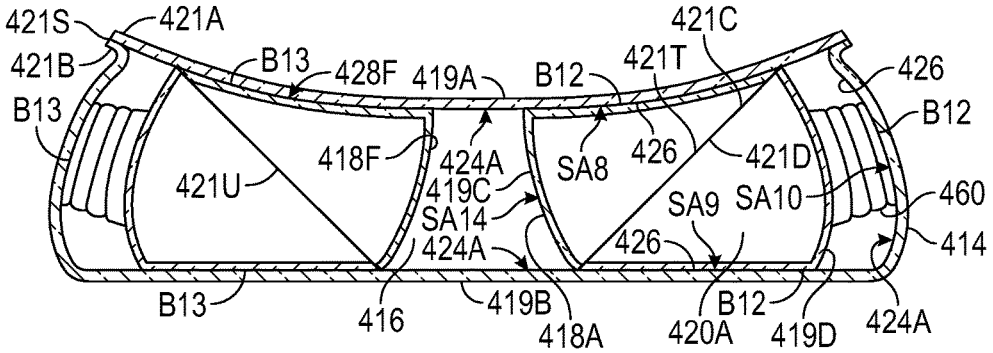
FIG. 16 is a schematic illustration in cross-sectional view of the cushioning assembly of FIG. 15 taken at lines 16-16 in FIG. 15.

As best shown in FIG. 16, the first bladder element 414 is formed from a first polymeric sheet 419A secured to the second polymeric sheet 419B at peripheral flanges 421A, 421B of the polymeric sheets 419A, 419B, forming a peripheral seam 421S. The second bladder element 418A may also be formed from a first polymeric sheet 419C and a second polymeric sheet 419D secured to one another at flanges 421C, 421D forming a peripheral seam 421T that surrounds the second bladder element 418A and seals the second fluid chamber 420A.

As best shown in FIG. 16, the second bladder element 418A is positioned in and secured to the bladder element 414 so that the flanges 421C, 421D and the peripheral seam 421T incline in a laterally outward direction. Bladder elements 418B, 418C, 418D, 418E, 418F, 418G, 418H, and 418I have similar peripheral flanges and peripheral seams and are positioned in the bladder element 414 and secured to the bladder element 414 so that the flanges and peripheral seams incline in a laterally outward direction.

With reference to FIG. 16, the first polymeric sheet 419A of the first bladder element 414 comprises an inner surface 424A having a first feature 426. The first feature 426 is the formed shape of the inner surface 424A that interfits with a shape of an outer surface 428A (FIG. 17) of the inflated second bladder element 418A and a deployable portion 460 of the second bladder element 418A, discussed herein. The inner surface 424A of the first bladder element 414 interfits with the outer surface 428A of the second bladder element 418A such that a first area of the inner surface 424A of the first bladder element 414 is aligned with a first area of the outer surface 428A of the second bladder element 418A at a bonded interface B12. The first area of the outer surface 428A is the area including surfaces SA11, SA12, and SA13 indicated in FIGS. 17 and 18. The first area of the inner surface 424A is the area including surfaces SA8, SA9, and SA10 in contact with surfaces SA11, SA12, and SA13, respectively and forming the bonded interface B12.

The area at surface SA14 of bladder element 418A is exposed to the first fluid chamber 416 and is away from the bonded interface B12. The bonded interface B12 is disposed on opposing portions of the inner surface 424A of the first bladder element 414. For example, upper surface SA8 and lower surface SA9 are opposing portions of the inner surface 424A.

Bladder element 418F may be referred to as a third bladder element. As shown in FIG. 16, bladder element 418F comprises an additional surface 428F having a third feature that is opposing surfaces of the third bladder element 418F that are bonded to the inner surface 424A of bladder element 414 as explained with respect to bladder element 418A. The first feature 426 is the formed shape of the inner surface 424A that further interfits with a shape of the outer surface 428F of the inflated third bladder element 418F such that an additional area of the inner surface 424A of the first bladder element 414 and the outer surface 428F of the third bladder element 418F establish an additional bonded interface B13 as shown in FIG. 16, and the third bladder element 418F is exposed to the first fluid chamber 416 away from the additional bonded interface B13. The third bladder element 418F also is formed from sheets secured to one another at peripheral flanges forming a peripheral seam 421U that inclines laterally outward when the cushioning assembly is secured in an article of footwear. Each of the remaining inner bladder elements 418B, 418C, 418D, and 418E, 418G are similarly configured and arranged. Bladder elements 418I and 418H do not have deployable portions.

Figure 17:
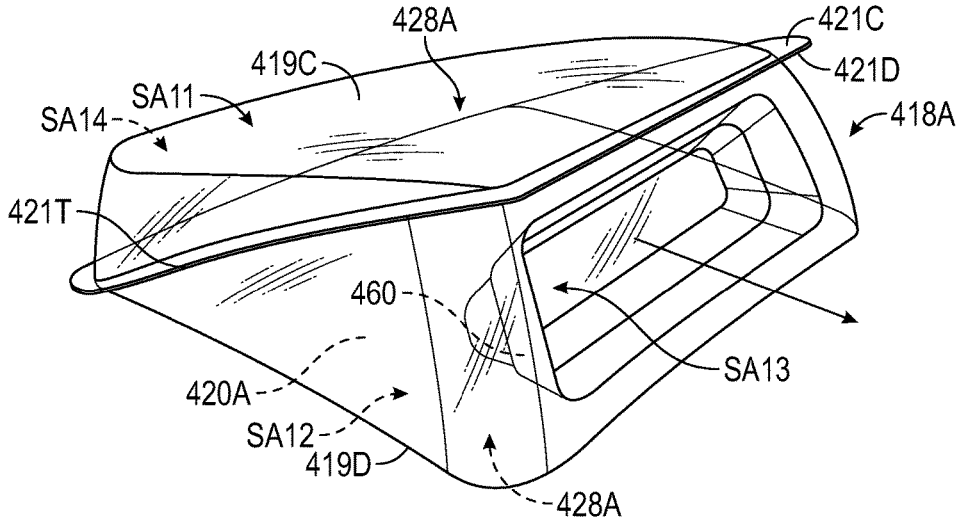
FIG. 17 is a schematic illustration in perspective view of an inner bladder element of the cushioning assembly of FIG. 15 with a deployable portion in an undeployed state.
Figure 18:
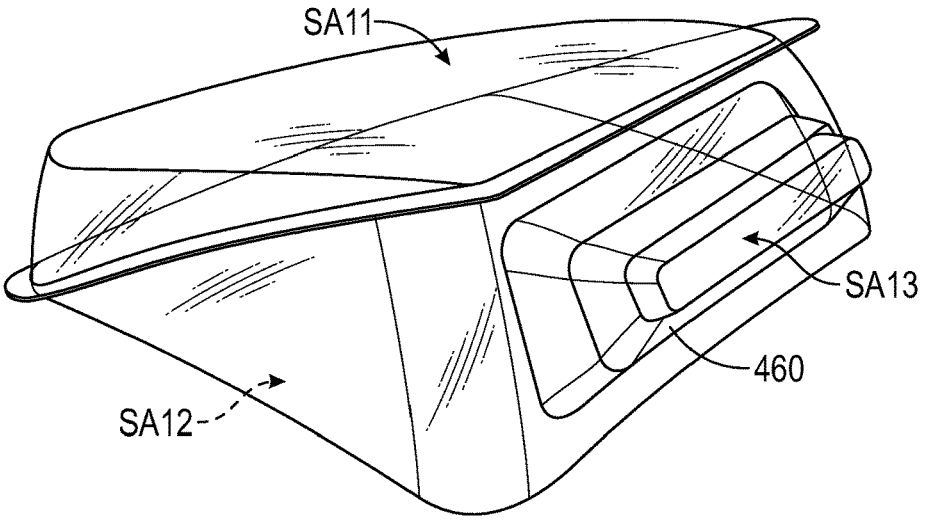
FIG. 18 is a schematic illustration in perspective view of the inner bladder element of FIG. 17 with the deployable portion in a deployed state.
Figure 19:
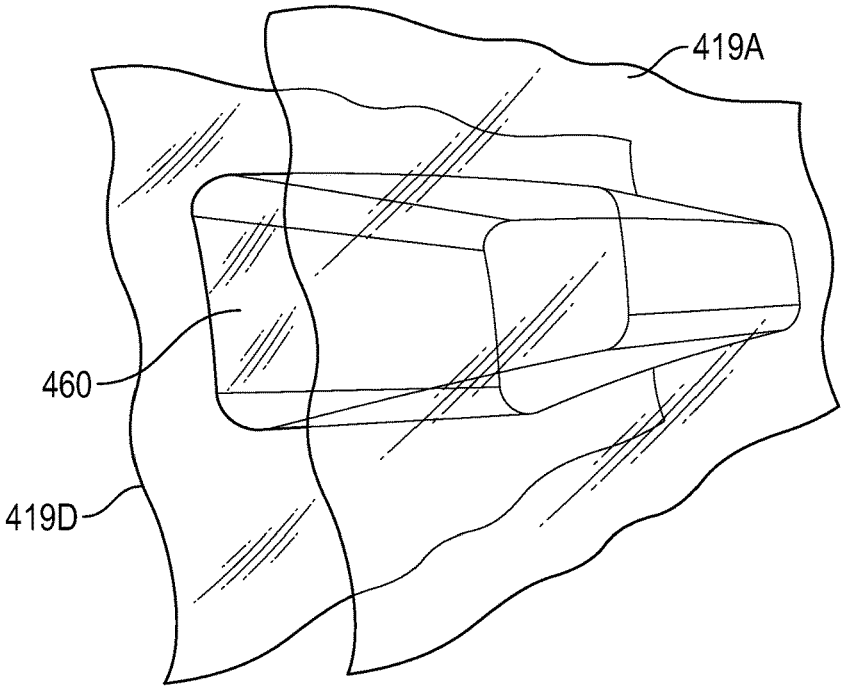
FIG. 19 is a schematic illustration in fragmentary perspective view of the cushioning assembly of FIG. 15.

The second bladder element 418A comprises a deployable portion 460 that protrudes inward prior to inflating the second fluid chamber 420A, such as when the second fluid chamber 420A is at ambient pressure as shown in FIG. 17. The deployable portion 460 deploys laterally outward into contact with a side portion of the inner surface 424A of the first bladder element 418A under pressurization of the second bladder element 418A. The side portion of the inner surface 424A is at surface area SA10. The bonded interface B12 includes the surface area SA10 of the inner surface 424A of the first bladder element 414, via the deployable portion 460, and includes the opposing portions at surface areas SA8 and SA9 of the inner surface 424A of the first bladder element 414 adjacent the side portion SA10.

In order to deploy the deployable portion 460 into contact with the inner surface 424A, the first bladder element 414 is positioned in a mold assembly with the first and second polymeric sheets 419A, 419B of the first bladder element 414 against opposing mold surfaces. The second bladder element 418A is not completely inflated and sealed until it is within the mold assembly, while the formed first and second polymeric sheets 419A, 419B are at elevated temperatures due to thermoforming. The deployable portion 460 thus deploys outward so that surface area SA13 is put into contact with the inner surface 424A at surface SA10, and bonds to the inner surface 424A when inflated, such as by thermal bonding. Air pressure during inflation of the second bladder element 418A ensures full contact of the surface SA13 with the inner surface 424A. Typically, it is difficult to achieve a secure bond of an inner bladder element to three sides of an inner surface of an outer bladder element without the use of complex mold assemblies with slides. A secure bond at opposing upper and lower surfaces SA8 and SA9 can be ensured with appropriate pressure between an upper and lower mold half of the mold assembly. The deployable portion 460 alleviates the difficulty of also ensuring a secure bond at surface SA10 at the side portion of the inner surface 424A.

As described with respect to the article of footwear 10, each of the bladder elements 414, 418A, 418B, 418C, 418D, 418E, 418F, 418G, 418H, and 418I may be inflated to have different pressures corresponding to the pressure map 50. For example, the third fluid chamber 420F may have a greater pressure than either of the second fluid chamber 420A and the first fluid chamber 416 when the article of footwear is in an unloaded state. Similarly, bladder element 418E may also be referred to as a third bladder element, and the fluid chamber 420E of bladder element 418E in the forefoot portion 13 may have a greater pressure than either of the second fluid chamber 420A and the first fluid chamber 416 when the article of footwear is in an unloaded state.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article comprising:

a cushioning assembly comprising:

a first bladder element forming a first fluid chamber; wherein the first bladder element includes a first sheet bonded to a second sheet at a peripheral flange to enclose the first fluid chamber;

a second bladder element within the first bladder element and forming a second fluid chamber sealed from and within the first fluid chamber; wherein:

the second fluid chamber has an inflation pressure above ambient pressure;

the first bladder element comprises an inner surface;

the second bladder element comprises an outer surface;

the inner surface of the first bladder element interfits with the outer surface of the second bladder element such that a first area of the inner surface of the first bladder element is aligned with and bonded to a first area of the outer surface of the second bladder element at a bonded interface;

the second bladder element comprises a deployable portion deployed laterally outward into contact with and bonded to a side portion of the inner surface of the first bladder element;

the bonded interface includes the side portion of the inner surface of the first bladder element bonded to the deployable portion, and further includes opposing portions of the inner surface of the first bladder element at an upper side and a lower side of the second bladder element and adjacent to the side portion; and the second bladder element is exposed to the first fluid chamber away from the bonded interface;

the second bladder element comprises a flange forming a peripheral seam displaced from the peripheral flange of the first bladder element and exposed to the first fluid chamber; the flange of the second bladder element surrounding the second bladder element and sealing the second fluid chamber; and the peripheral seam of the second bladder element inclines within the first bladder element from the lower side of the second bladder element to the upper side of the second bladder element between the opposing portions of the inner surface of the first bladder element.

2. The article of claim 1, further comprising: a third bladder element within the first bladder element and forming a third fluid chamber sealed from both the first fluid chamber and the second fluid chamber; and wherein an additional area of the inner surface of the first bladder element and an outer surface of the third bladder element establish an additional bonded interface and the third bladder element is exposed to the first fluid chamber away from the additional bonded interface.

3. The article of claim 2, wherein the article is an article of footwear that comprises a forefoot portion, a midfoot portion, and a heel portion; wherein the first bladder element extends from the forefoot portion to the heel portion; and wherein the second bladder element is positioned in the heel portion and the third bladder element is positioned in the forefoot portion.

4. The article of claim 3, wherein the third fluid chamber is pressurized to an inflation pressure greater than either of the second fluid chamber and the first fluid chamber.

5. The article of claim 4, wherein the cushioning assembly is configured to support a foot, and wherein the second fluid chamber and the third fluid chamber have inflation pressures that correspond with pressures applied by a corresponding portion of the foot.

6. The article of claim 1, wherein the first sheet comprises a first polymeric sheet and the second sheet comprises a second polymeric sheet.

7. The article of claim 6, wherein the article is an article of footwear, and further comprising: an outsole secured to the second polymeric sheet of the first bladder element.

8. The article of claim 1, wherein the article is an article of footwear, and further comprising: an upper secured to the first bladder element.

9. The article of claim 1, wherein the peripheral seam inclines in a laterally outward direction.

10. The article of claim 1, wherein the side portion of the inner surface of the first bladder element is exposed to the first fluid chamber around the deployable portion.

11. An article comprising:

a cushioning assembly comprising:

a first bladder element forming a first fluid chamber;

a second bladder element within the first bladder element and forming a second fluid chamber sealed from and within the first fluid chamber;

a third bladder element within the first bladder element and forming a third fluid chamber sealed from both the first fluid chamber and the second fluid chamber; wherein:

the second fluid chamber has an inflation pressure above ambient pressure;

the first bladder element comprises an inner surface;

the second bladder element comprises an outer surface;

the inner surface of the first bladder element interfits with the outer surface of the second bladder element such that a first area of the inner surface of the first bladder element is aligned with and bonded to a first area of the outer surface of the second bladder element at a bonded interface;

the second bladder element comprises a deployable portion deployed laterally outward into contact with and bonded to a side portion of the inner surface of the first bladder element;

the bonded interface includes the side portion of the inner surface of the first bladder element bonded to the deployable portion, and further includes opposing portions of the inner surface of the first bladder element at an upper side and a lower side of the second bladder element and adjacent to the side portion;

the second bladder element is exposed to the first fluid chamber away from the bonded interface;

the third fluid chamber has an inflation pressure above ambient pressure;

the third bladder element comprises a deployable portion deployed laterally outward into contact with and bonded to an additional side portion of the inner surface of the first bladder element forming an additional bonded interface;

the additional side portion is opposite from the side portion to which the deployable portion of the second bladder element is bonded;

the first bladder element includes a first sheet bonded to a second sheet at a peripheral flange to enclose the first fluid chamber;

the second bladder element comprises a flange forming a peripheral seam entirely displaced from the peripheral flange of the first bladder element and exposed to the first fluid chamber; the flange of the second bladder element surrounding the second bladder element and sealing the second fluid chamber;

the peripheral seam of the second bladder element inclines within the first bladder element from the lower side of the second bladder element to the upper side of the second bladder element between the opposing portions of the inner surface of the first bladder element and toward the side portion to which the deployable portion of the second bladder element is bonded;

the third bladder element comprises a flange forming a peripheral seam that surrounds the third bladder element and seals the third fluid chamber; and the peripheral seam of the third bladder element inclines within the first bladder element toward the additional side portion to which the deployable portion of the third bladder element is bonded.

12. The article of claim 11, wherein the article is an article of footwear that comprises a forefoot portion, a midfoot portion, and a heel portion; wherein the first bladder element extends from the forefoot portion to the heel portion; and wherein the second bladder element is positioned in the heel portion and the third bladder element is positioned in the heel portion.

13. An article of footwear comprising:

a first bladder element including a first sheet bonded to a second sheet at a peripheral flange to enclose a first fluid chamber;

a second bladder element and a third bladder element each disposed within the first fluid chamber and spaced apart from one another by a portion of the first fluid chamber;

wherein the second bladder element and the third bladder element each include a deployable portion, the deployable portion of the second bladder element deployed laterally outward into contact with and bonded to a side portion of an inner surface of the first bladder element, the deployable portion of the third bladder element deployed laterally outward into contact with and bonded to a side portion of an inner surface of the first bladder element opposite to the side portion to which the second bladder element is bonded, and each of the second bladder element and the third bladder element further including an upper side and a lower side bonded to opposing portions of the inner surface of the first bladder element; and wherein the second bladder element and the third bladder element each include a peripheral seam displaced from the peripheral flange of the first bladder element, exposed to the first fluid chamber, and extending between the opposing portions of the inner surface of the first bladder element.

14. The article of footwear of claim 13, wherein the side portion of the inner surface of the first bladder element to which the deployable portion of the second bladder element is bonded and the side portion of the inner surface of the first bladder element to which the deployable portion of the third bladder element is bonded are exposed to the first fluid chamber around the deployable portion of the second bladder element and around the deployable portion of the third bladder element.

* * * * *